US008007154B2

(12) United States Patent
Okada et al.

(10) Patent No.: US 8,007,154 B2
(45) Date of Patent: Aug. 30, 2011

(54) VEHICLE LAMP

(75) Inventors: Hidetaka Okada, Tokyo (JP); Nao Nakano, Tokyo (JP); Norihide Todoroki, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 281 days.

(21) Appl. No.: 12/330,493

(22) Filed: Dec. 8, 2008

(65) Prior Publication Data

US 2009/0201694 A1 Aug. 13, 2009

(30) Foreign Application Priority Data

Dec. 6, 2007 (JP) ..... 2007-316453

(51) Int. Cl.
*B60Q 3/04* (2006.01)

(52) U.S. Cl. ..... 362/543; 362/509; 362/545; 362/518; 362/520

(58) Field of Classification Search ..... 362/605–607, 362/509, 169, 217.02, 217.04, 217.05, 217.09, 362/237, 240, 242, 249.02, 268, 296.01, 362/300, 301, 307, 309, 326, 327, 328, 332, 362/333, 355, 516–518, 520–522, 545
See application file for complete search history.

(56) References Cited

U.S. PATENT DOCUMENTS

| | | | | | |
|---|---|---|---|---|---|
| 1,991,866 | A * | 2/1935 | Rich | ..... | 362/520 |
| 3,532,871 | A * | 10/1970 | Shipman | ..... | 362/506 |
| 4,812,955 | A * | 3/1989 | Beswick et al. | ..... | 362/240 |
| 4,823,246 | A * | 4/1989 | Dilouya | ..... | 362/328 |
| 4,855,877 | A * | 8/1989 | Otaka | ..... | 362/509 |
| 6,053,623 | A * | 4/2000 | Jones et al. | ..... | 362/310 |
| 6,146,004 | A * | 11/2000 | Flottmeyer et al. | ..... | 362/522 |
| 2001/0015899 | A1 * | 8/2001 | Kondo et al. | ..... | 362/543 |
| 2002/0030998 | A1 * | 3/2002 | Natsume | ..... | 362/509 |

FOREIGN PATENT DOCUMENTS

| | | | |
|---|---|---|---|
| JP | 2001047453 | A * | 2/2001 |
| JP | 2001266614 | | 9/2001 |

OTHER PUBLICATIONS

English machine translation of JP 2001047453 Retrieved Nov. 16, 2010.*

* cited by examiner

*Primary Examiner* — Anabel M Ton
*Assistant Examiner* — Danielle Allen
(74) *Attorney, Agent, or Firm* — Kenealy Vaidya LLP

(57) ABSTRACT

A vehicle lamp can include a light source, a reflector having a parabolic reflective surface for reflecting light beams from the light source, and a lens formed in a generally rectangular shape (i.e., square, rectangular, substantially square, substantially rectangular). The lens can include a plurality of lens cut portions for diffusing the generally parallel light beams from the reflector. The principal optical axis of the vehicle lamp can be aligned with the center of the lens. A plurality of ridge lines or valley lines can extend radially from the principal optical axis to divide the generally rectangular lens into at least a first lens cut portion, a second lens cut portion, a third lens cut portion, and a fourth lens cut portion. The first lens cut portion can be a substantial mirror image of the second lens cut portion, and the third lens cut portion can be a substantial mirror image of the fourth lens cut portion. Part of the parallel light beams from the reflector can be diffused in the left and right directions through the first and second lens cut portions, and at the same time, part of the parallel light beams from the reflector can be diffused in the up and down directions through the third and fourth lens cut portions.

20 Claims, 22 Drawing Sheets

VEHICLE LAMP

This application claims the priority benefit under 35 U.S.C. §119 of Japanese Patent Application No. 2007-316453 filed on Dec. 6, 2007, which is hereby incorporated in its entirety by reference.

BACKGROUND

1. Technical Field

The presently disclosed subject matter relates to vehicle lamps. More particularly, to vehicle lamps which include a light source, a reflector having a parabolic reflective surface configured to reflect light beams, emitted from the light source, as generally parallel reflected light beams, and a lens having a plurality of lens cut portions configured to diffuse the generally parallel light beams coming from the parabolic reflective surface of the reflector. In particular, the presently disclosed subject matter relates to a vehicle signal lamp which can be configured to be capable of easily forming a light distribution pattern, the light distribution pattern having left-right symmetry about the vertical plane that contains the principal optical axis of the vehicle signal lamp as well as up-down symmetry about the horizontal plane that contains the principal optical axis of the vehicle signal lamp.

2. Description of the Related Art

Vehicle signal lamps have been conventionally known which include a light source; a reflector having a parabolic reflective surface configured to reflect light beams, emitted from the light source, as generally parallel reflected light beams; and a lens having a plurality of lens cut portions configured to diffuse the generally parallel light beams coming from the parabolic reflective surface of the reflector. For example, a vehicle signal lamp of this type is disclosed and illustrated in FIGS. 1 and 2 in Japanese Patent Application Laid-Open No. 2001-266614. This signal lamp is shown herein as FIG. 1 and FIG. 2.

The conventional vehicle signal lamp of FIGS. 1 and 2 is configured such that the lens which is generally rectangular in shape is divided by a plurality of vertically extending ridge lines or valley lines into a plurality of lens cut portions. Unless otherwise specified, all the directions or orientations referred to herein are based on those that are defined with the lamp installed in a vehicle. For example, the left and right directions are defined as the directions along the width of the vehicle when viewed from in front of the vehicle, while the longitudinal direction is defined as being consistent with the lengthwise direction of the vehicle, except when referring to a longitudinal axis of a particular object.

More specifically, the conventional vehicle signal lamp allows each of the lens cut portions to diffuse the generally parallel light beams coming from the parabolic reflective surface of the reflector into left and right directions.

The vehicle signal lamp shown in FIGS. 1 and 2 is configured so that the principal optical axis of the vehicle signal lamp (the optical axis of the light source) is not aligned with the center of the generally rectangular lens. Furthermore, with respect to the vertical plane containing the principal optical axis of the vehicle signal lamp (the optical axis of the light source), no mirror image relationship is established between the plurality of lens cut portions on the right side of the vertical plane and the plurality of lens cut portions on the left side thereof.

That is, the vehicle signal lamp disclosed in Japanese Patent Application Laid-Open No. 2001-266614 is configured so that the generally rectangular lens has no left-right symmetry about the vertical plane containing the principal optical axis of the vehicle signal lamp (the optical axis of the light source). It can thus be difficult or impossible to form a light distribution pattern having left-right symmetry.

SUMMARY

The presently disclosed subject matter was devised in view of these and other problems, features, and characteristics, and in association with the conventional art. According to an aspect of the presently disclosed subject matter, a vehicle lamp which can easily form a light distribution pattern, the light distribution pattern having left-right symmetry about the vertical plane containing the principal optical axis of the vehicle lamp as well as up-down symmetry about the horizontal plane containing the principal optical axis of the vehicle lamp.

According to another aspect of the presently disclosed subject matter, a vehicle lamp having a principal optical axis can include: a light source; a reflector having a parabolic reflective surface configured to reflect light beams, emitted from a light source, as generally parallel reflected light beams; and a lens formed in a generally rectangular shape and having a plurality of lens cut portions configured to diffuse the generally parallel light beams coming from the parabolic reflective surface of the reflector. The term generally rectangular as used herein can be defined as a square shape, a rectangular shape, a substantially square shape, and/or a substantially rectangular shape. In the vehicle lamp configured as described above, the principal optical axis of the vehicle lamp can be configured to be aligned with the center of the lens, and a plurality of ridge lines or valley lines extending generally radially from the principal optical axis of the vehicle lamp can divide the generally rectangular lens into at least a first lens cut portion, a second lens cut portion, a third lens cut portion, and a fourth lens cut portion. Furthermore, the first lens cut portion located below a horizontal plane containing the principal optical axis of the vehicle lamp can have a mirror image relationship with the second lens cut portion located above the horizontal plane. Additionally, the third lens cut portion located to the left of the vertical plane containing the principal optical axis of the vehicle lamp can have a mirror image relationship with the fourth lens cut portion located to the right of the vertical plane. The vehicle lamp can be configured such that the generally parallel light beams coming from the parabolic reflective surface of the reflector are diffused at least in the left and right directions through the first lens cut portion and the second lens cut portion, and at the same time, the generally parallel light beams coming from the parabolic reflective surface of the reflector are diffused at least in the up and down directions through the third lens cut portion and the fourth lens cut portion.

The aforementioned vehicle lamp can be configured such that a light incident surface of the lens cut portion protrudes rearward of an imaginary plane which is defined by offsetting a light transmitting surface of the lens cut portion toward the light incident side, thereby allowing the lens cut portion to diffuse the generally parallel light beams, coming from the parabolic reflective surface of the reflector, in the left and right directions and/or in the up and down directions.

Furthermore, the aforementioned vehicle lamp can be configured such that a light transmitting surface of the lens cut portion protrudes frontward of an imaginary plane which is defined by offsetting a light incident surface of the lens cut portion toward the light transmitting side, thereby allowing the lens cut portion to diffuse the generally parallel light beams, coming from the parabolic reflective surface of the reflector, in the left and right directions and/or in the up and down directions.

Furthermore, the aforementioned vehicle lamp can be configured such that the lens cut portion located on one side separated by the ridge line or valley line from another lens cut portion located on the other side are coupled to each other at the position of the ridge line or valley line.

The vehicle lamp of the presently disclosed subject matter configured as mentioned above is provided with the light source; the reflector having the parabolic reflective surface configured to reflect light beams, emitted from the light source, as generally parallel reflected light beams; and the lens formed in a generally rectangular shape and having a plurality of lens cut portions configured to diffuse the generally parallel light beams coming from the parabolic reflective surface of the reflector.

Furthermore, the principal optical axis of the vehicle lamp is adapted to be aligned with the center of the lens. Furthermore, the plurality of ridge lines or valley lines extending generally radially from the principal optical axis of the vehicle lamp can divide the generally rectangular lens into at least the first lens cut portion, the second lens cut portion, the third lens cut portion, and the fourth lens cut portion.

At this time, the first lens cut portion located below the horizontal plane containing the principal optical axis of the vehicle lamp can have a mirror image relationship with the second lens cut portion located above the horizontal plane. Furthermore, the third lens cut portion located to the left of the vertical plane containing the principal optical axis of the vehicle lamp can have a mirror image relationship with the fourth lens cut portion located to the right of the vertical plane.

In this configuration, the generally parallel light beams coming from the parabolic reflective surface of the reflector can be diffused at least in the left and right directions through the first lens cut portion and the second lens cut portion. Furthermore, the generally parallel light beams coming from the parabolic reflective surface of the reflector can be diffused at least in the lower and upper directions through the third lens cut portion and the fourth lens cut portion.

It is thus possible to easily form a light distribution pattern which has left-right symmetry about the vertical plane containing the principal optical axis of the vehicle lamp as well as up-down symmetry about the horizontal plane that contains the principal optical axis of the vehicle lamp.

The vehicle lamp mentioned above can be configured such that the light incident surface of the lens cut portion protrudes rearward of the imaginary plane which is defined by offsetting the light transmitting surface of the lens cut portion toward the light incident side. This allows the lens cut portion to diffuse the generally parallel light beams, coming from the parabolic reflective surface of the reflector, in the left and right directions and/or in the up and down directions.

Alternatively, the light transmitting surface of the lens cut portion protrudes rearward of the imaginary plane which is defined by offsetting the light incident surface of the lens cut portion toward the light transmitting side, thereby allowing the lens cut portion to diffuse the generally parallel light beams, coming from the parabolic reflective surface of the reflector, in the left and right directions and/or in the up and down directions.

Furthermore, the lens cut portion located on one side separated by the ridge line or valley line from another lens cut portion located on the other side are coupled to each other at the position of the ridge line or valley line.

That is, there exists no step height in the longitudinal direction (in the direction of depth) between the lens cut portion located on one side separated by the ridge line or valley line from another lens cut portion located on the other side. Accordingly, when the lens is formed of a resin material by molding, the lens can be more easily taken out of (ejected from) the molding die, as compared with the case where a step height exists in the longitudinal direction (in the direction of depth) between the lens cut portion located on one side separated by the ridge line or valley line from another lens cut portion located on the other side.

BRIEF DESCRIPTION OF THE DRAWINGS

These and other characteristics, features, and advantages of the presently disclosed subject matter will become clear from the following description with reference to the accompanying drawings, wherein.

DETAILED DESCRIPTION OF EXEMPLARY EMBODIMENTS

A description will now be made below to embodiments of vehicle lamps made in accordance with principles of the presently disclosed subject matter with reference to the accompanying drawings in accordance.

Figure 1:
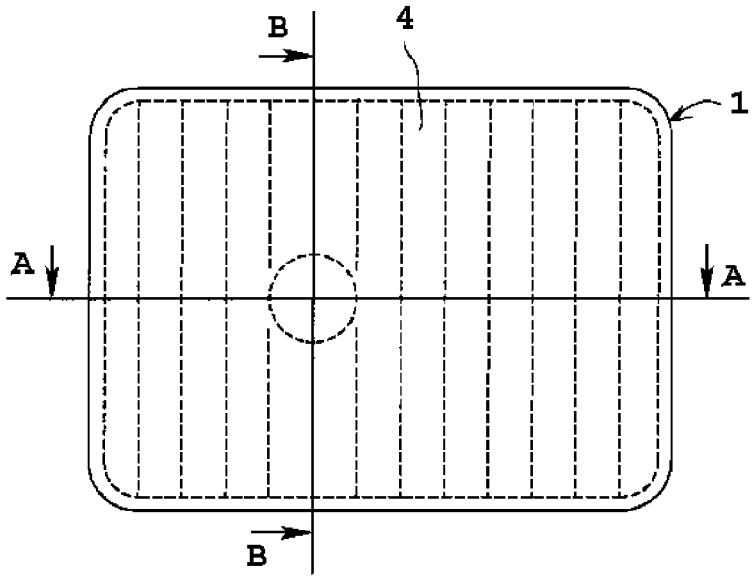
Fig. 1 Conventional Art
FIG. 1 is a front view of a conventional vehicle signal lamp illustrated in FIG. 1 of Japanese Patent Application Laid-Open No. 2001-266614.
Figure 2:
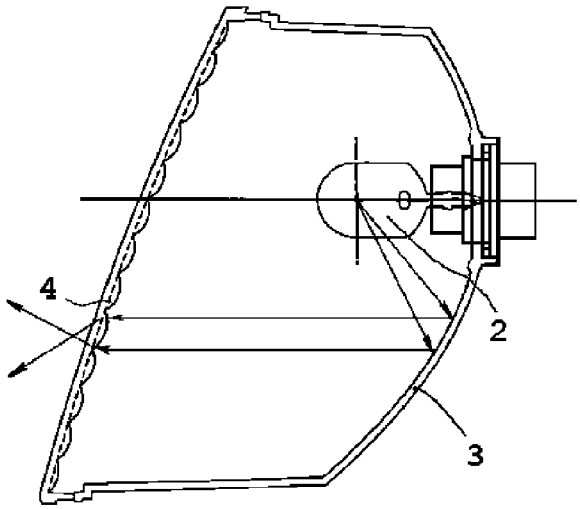
Fig. 2 Conventional Art
FIG. 2 is a cross-sectional view of the conventional vehicle signal lamp.
Figure 3A:
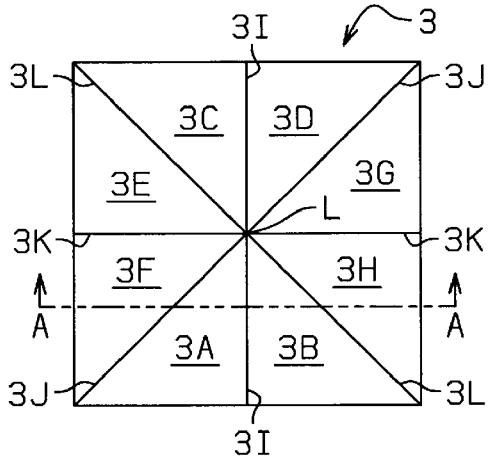
FIGS. 3A, 3B, and 3C are views illustrating a vehicle lamp of a first exemplary embodiment.
Figure 3B:
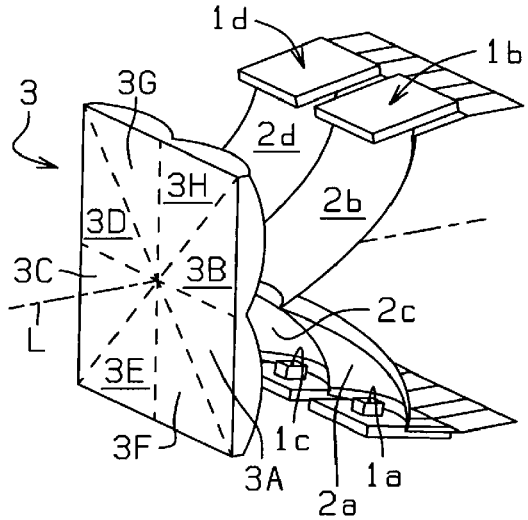
Figure 3C:
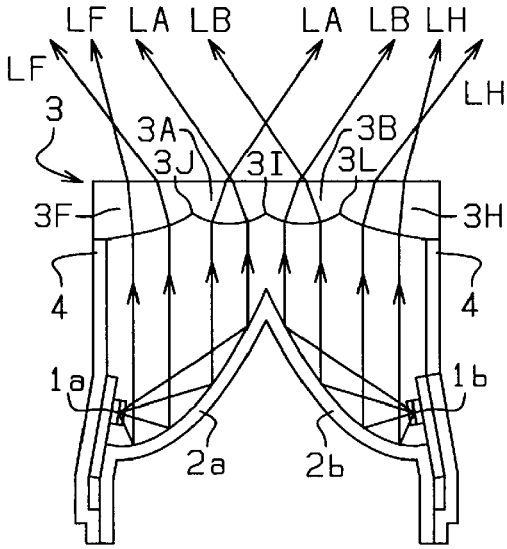

Now, a description will be made with respect to a vehicle lamp according to a first exemplary embodiment of the presently disclosed subject matter. FIGS. 3A to 3C are views illustrating a vehicle lamp of the first exemplary embodiment. More specifically, FIG. 3A is a front view illustrating a vehicle lamp of the first exemplary embodiment, FIG. 3B being a perspective view thereof, FIG. 3C being a cross-sectional view taken along line A-A of FIG. 3A. It should be noted that FIG. 3B shows the vehicle lamp turned by 90 degrees in order to show the reflectors and LEDs clearly.

As shown in FIGS. 3A to 3C, the vehicle lamp according to the first exemplary embodiment of the presently disclosed subject matter can include light sources 1*a*, 1*b*, 1*c*, and 1*d*; and reflectors 2*a*, 2*b*, 2*c*, and 2*d*, each having a parabolic reflective surface configured to reflect light beams, emitted from the respective light sources, as generally parallel reflected light beams. The vehicle lamp can also include a lens 3 having a plurality of lens cut portions configured to diffuse the generally parallel light beams coming from the parabolic reflective surface of the reflectors 2*a*, 2*b*, 2*c*, and 2*d*.

More specifically, the vehicle lamp of the first exemplary embodiment shown in FIG. 3B can be provided with the light sources 1*a*, 1*b*, 1*c*, and 1*d* such as LEDs. Note that the number of light sources is not limited to four, and any number of light sources can be provided.

As shown in FIG. 3C, in the vehicle signal lamp of the first exemplary embodiment, light beams emitted from the light source 1*a* are reflected by the parabolic reflective surface of the reflector 2*a* to form generally parallel light beams. Furthermore, light beams emitted from the light source 1*b* are reflected by the parabolic reflective surface of the reflector 2*b* to form generally parallel light beams. Likewise, light beams emitted from the light source 1*c* are reflected by the parabolic reflective surface of the reflector 2*c* to form generally parallel light beams, while light beams emitted from the light source 1*d* are reflected by the parabolic reflective surface of the reflector 2*d* to form generally parallel light beams (see FIG. 3B).

Furthermore, as shown in FIGS. 3A, 3B, and 3C, the vehicle signal lamp of the first exemplary embodiment is configured such that the generally parallel light beams coming from the parabolic reflective surface of the reflectors 2*a*, 2*b*, 2*c*, and 2*d* are diffused by the lens 3 which has, for example, eight lens cut portions 3A, 3B, 3C, 3D, 3E, 3F, 3G, and 3H.

A description will now be made in more detail with reference to the cross-sectional view (horizontal plane) shown in FIG. 3C. Within this horizontal plane, some part of the generally parallel light beams which were emitted from the light source 1*a* and then reflected by the parabolic reflective surface of the reflector 2*a* impinges upon the lens cut portion 3F. Then, the light beams are diffused through the lens cut portion 3F in the left and right directions and then projected as diffused light LF frontward of the vehicle signal lamp (upward in FIG. 3C). Furthermore, the other part of the generally parallel light beams emitted from the light source 1*a* and then reflected by the parabolic reflective surface of the reflector 2*a* impinges upon the lens cut portion 3A. Then, the light beams are diffused through the lens cut portion in the left and right directions and then projected as diffused light LA frontward of the vehicle lamp (upward in FIG. 3C).

Furthermore, some part of the generally parallel light beams emitted from the light source 1*b* and then reflected by the parabolic reflective surface of the reflector 2*b* impinges upon the lens cut portion 3B. Then, the light beams are diffused through the lens cut portion 3B in the left and right directions and then projected as diffused light LB frontward of the vehicle lamp (upward in FIG. 3C). Furthermore, the other part of the generally parallel light beams emitted from the light source 1*b* and then reflected by the parabolic reflective surface of the reflector 2*b* impinges upon the lens cut portion 3H. Then, the light beams are diffused through the lens cut portion 3H as diffused light LH in the left and right directions and then projected frontward of the vehicle lamp (upward in FIG. 3C).

It should be noted that, as shown in FIG. 3B, the vehicle lamp of the first exemplary embodiment allows a housing 4 (not shown in FIG. 3B) to connect between the light sources 1*a*, 1*b*, 1*c*, and 1*d*, the reflectors 2*a*, 2*b*, 2*c*, and 2*d*, and the lens 3.

A description will now be made with respect to the lens 3 of the vehicle lamp according to the first exemplary embodiment. As shown in FIG. 3A, the lens 3 is configured to look generally rectangular (as indicated above, the term generally rectangular as used herein can be defined as a square shape, a rectangular shape, a substantially square shape, and/or a substantially rectangular shape) when viewed from in front of the vehicle lamp. Furthermore, the principal optical axis L of the vehicle lamp can be configured to be aligned with the center of the generally rectangular lens 3. Here, the generally rectangular lens 3 is divided into the eight lens cut portions 3A, 3B, 3C, 3D, 3E, 3F, 3G, and 3H by valley lines 3I, 3J, 3K, and 3L which extend generally radially from the principal optical axis L of the vehicle lamp.

Figure 4A:
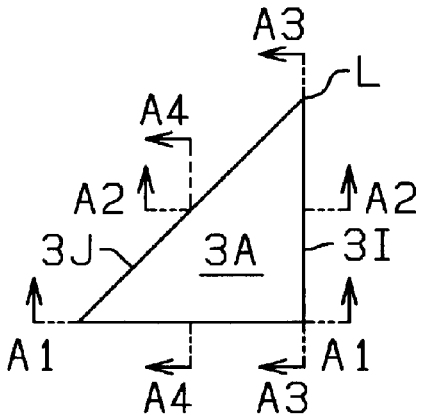
FIGS. 4A, 4B, 4C, 4D, and 4E are views illustrating in detail a lens cut portion 3A of a lens 3 shown in FIGS. 3A to 3C.
Figure 4D:
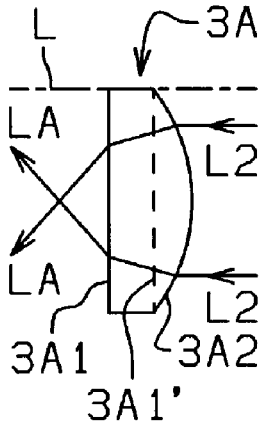
Figure 4E:
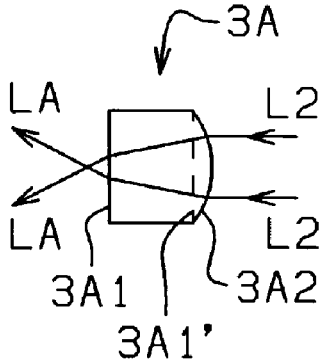
Figure 4B:
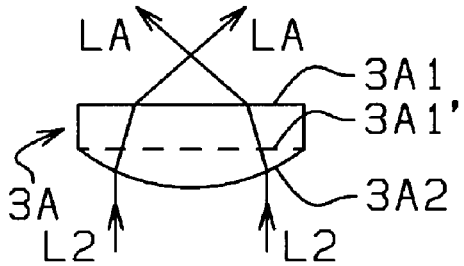
Figure 4C:
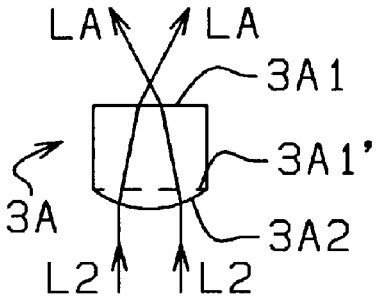

FIGS. 4A to 4E are views illustrating in detail the lens cut portion 3A of the lens 3 shown in FIGS. 3A to 3C. More specifically, FIG. 4A is a front view of the lens cut portion 3A, FIG. 4B is a cross-sectional view taken along line A1-A1 of FIG. 4A (a view showing the lower end face of the lens cut portion 3A), FIG. 4C is a cross-sectional view taken along line A2-A2 of FIG. 4A, FIG. 4D is a cross-sectional view taken along line A3-A3 of FIG. 4A, and FIG. 4E is a cross-sectional view taken along line A4-A4 of FIG. 4A.

Within the cross section (horizontal plane) of the vehicle lamp of the first exemplary embodiment shown in FIG. 4B and FIG. 4C, a light incident surface 3A2 of the lens cut portion 3A protrudes rearward of an imaginary plane 3A1' which is defined by offsetting a light transmitting surface 3A1 of the lens cut portion 3A toward a light incident side (downward in FIGS. 4B and 4C, toward the reflector 2*a*). Therefore, in the vehicle lamp of the first exemplary embodiment as shown in FIGS. 4B and 4C, generally parallel light beams L2 coming from the parabolic reflective surface of the reflector 2*a* (see FIGS. 3B and 3C) are diffused by the lens cut portion 3A in the left and right directions and then projected as the diffused light LA frontward of the vehicle lamp (upward in FIGS. 4B and 4C).

Furthermore, within the cross section (vertical plane) of the vehicle lamp of the first exemplary embodiment as shown in FIG. 4D and FIG. 4E, the light incident surface 3A2 of the lens cut portion 3A protrudes rearward of the imaginary plane 3A1' which is defined by offsetting the light transmitting surface 3A1 of the lens cut portion 3A toward the light incident side (rightward in FIGS. 4D and 4E, toward the reflector 2*a*). Therefore, in the vehicle lamp of the first exemplary embodiment as shown in FIGS. 4D and 4E, the generally parallel light beams L2 coming from the parabolic reflective surface of the reflector 2*a* (see FIGS. 3B and 3C) are diffused by the lens cut portion 3A in the up and down directions and projected as the diffused light LA frontward of the vehicle lamp (leftward in FIGS. 4D and 4E).

Furthermore, according to the vehicle lamp of the first exemplary embodiment as shown in FIG. 3A, the lens cut portion 3A and the lens cut portion 3C are arranged in a mirror image relationship with respect to the horizontal plane containing the principal optical axis L of the vehicle lamp. Additionally, as shown in FIG. 3B, the light source 1*a* and the parabolic reflective surface of the reflector 2*a* are arranged in a mirror image relationship with the light source 1*c* and the parabolic reflective surface of the reflector 2*c* with respect to the horizontal plane containing the principal optical axis L of the vehicle lamp. Therefore, according to the vehicle lamp of the first exemplary embodiment as shown in FIGS. 3A and 3B, the generally parallel light beams coming from the parabolic reflective surface of the reflector 2*c* are diffused by the lens cut portion 3C in the left and right directions and projected as diffused light frontward of the vehicle lamp (leftward in FIG. 3B). Furthermore, the generally parallel light beams coming from the parabolic reflective surface of the reflector 2*c* are diffused by the lens cut portion 3C in the up and down directions and projected as diffused light frontward of the vehicle lamp (leftward in FIG. 3B).

Furthermore, according to the vehicle lamp of the first exemplary embodiment as shown in FIG. 3A, the lens cut portion 3A and the lens cut portion 3B are arranged in a mirror image relationship with respect to the vertical plane containing the principal optical axis L of the vehicle lamp. Furthermore, as shown in FIG. 3B, the light source 1*a* and the parabolic reflective surface of the reflector 2*a* are arranged in a mirror image relationship with the light source 1*b* and the parabolic reflective surface of the reflector 2*b* with respect to the vertical plane containing the principal optical axis L of the vehicle lamp. Therefore, as shown in FIGS. 3A, 3B, and 3C, the vehicle lamp of the first exemplary embodiment is configured such that the generally parallel light beams coming from the parabolic reflective surface of the reflector 2*b* are diffused by the lens cut portion 3B in the left and right directions and projected as the diffused light LB frontward of the vehicle lamp (leftward in FIG. 3B, upward in FIG. 3C). Furthermore, the generally parallel light beams coming from the parabolic reflective surface of the reflector 2*b* are diffused by the lens cut portion 3B in the up and down directions, and projected as diffused light frontward of the vehicle lamp (leftward in FIG. 3B, upward in FIG. 3C).

Furthermore, according to the vehicle lamp of the first exemplary embodiment as shown in FIG. 3A, the lens cut portion 3B and the lens cut portion 3D are arranged in a mirror image relationship with respect to the horizontal plane containing the principal optical axis L of the vehicle lamp. Furthermore, as shown in FIG. 3B, the light source 1*b* and the parabolic reflective surface of the reflector 2*b* are arranged in a mirror image relationship with the light source 1*d* and the parabolic reflective surface of the reflector 2*d* with respect to the horizontal plane containing the principal optical axis L of the vehicle lamp. Therefore, as shown in FIGS. 3A, 3B, and 3C, the vehicle lamp of the first exemplary embodiment is configured such that the generally parallel light beams coming from the parabolic reflective surface of the reflector 2*d* are diffused by the lens cut portion 3D in the left and right directions and projected as the diffused light frontward of the vehicle lamp (leftward in FIG. 3B). Furthermore, the generally parallel light beams coming from the parabolic reflective surface of the reflector 2*d* are diffused by the lens cut portion 3D in the up and down directions, and projected as diffused light frontward of the vehicle lamp (leftward in FIG. 3B).

Figure 5C:
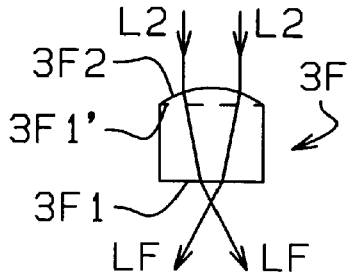
FIGS. 5A, 5B, 5C, 5D, and 5E are views illustrating in detail a lens cut portion 3F of the lens 3 shown in FIGS. 3A to 3C.
Figure 5B:
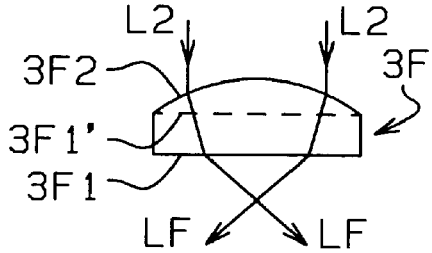
Figure 5E:
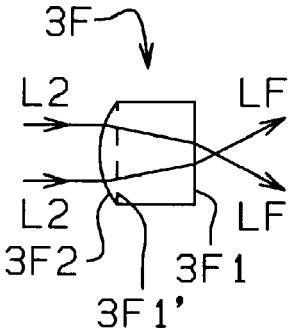
Figure 5D:
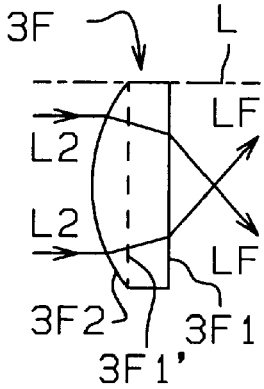
Figure 5A:
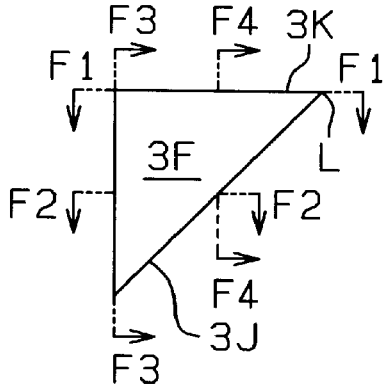

FIGS. 5A to 5E are views illustrating in detail the lens cut portion 3F of the lens 3 shown in FIGS. 3A to 3C. More specifically, FIG. 5A is a front view of the lens cut portion 3F, FIG. 5B is a cross-sectional view taken along line F1-F1 of FIG. 5A, and FIG. 5C is a cross-sectional view taken along line F2-F2 of FIG. 5A. FIG. 5D is a cross-sectional view taken along line F3-F3 of FIG. 5A (a view showing the left end face of the lens cut portion 3F), and FIG. 5E is a cross-sectional view taken along line F4-F4 of FIG. 5A.

Within the cross section (horizontal plane) of the vehicle lamp of the first exemplary embodiment shown in FIG. 5B and FIG. 5C, a light incident surface 3F2 of the lens cut portion 3F protrudes rearward of an imaginary plane 3F1' which is defined by offsetting a light transmitting surface 3F1 of the lens cut portion 3F toward a light incident side (upward in FIGS. 5B and 5C, toward the reflector 2*a*). Therefore, in the vehicle lamp of the first exemplary embodiment as shown in FIGS. 5B and 5C, generally parallel light beams L2 coming from the parabolic reflective surface of the reflector 2*a* (see FIGS. 3B and 3C) are diffused by the lens cut portion 3F in the left and right directions and then projected as the diffused light LF frontward of the vehicle lamp (downward in FIGS. 5B and 5C).

Furthermore, within the cross section (vertical plane) of the vehicle lamp of the first exemplary embodiment as shown in FIG. 5D and FIG. 5E, the light incident surface 3F2 of the lens cut portion 3F protrudes rearward of the imaginary plane 3F1' which is defined by offsetting the light transmitting surface 3F1 of the lens cut portion 3F toward the light incident side (leftward in FIGS. 5D and 5E, toward the reflector 2*a*). Therefore, in the vehicle lamp of the first exemplary embodiment as shown in FIGS. 5D and 5E, the generally parallel light beams L2 coming from the parabolic reflective surface of the reflector 2*a* (see FIGS. 3B and 3C) are diffused by the lens cut portion 3F in the up and down directions and projected as the diffused light LF frontward of the vehicle lamp (rightward in FIGS. 5D and 5E).

Furthermore, according to the vehicle lamp of the first exemplary embodiment as shown in FIG. 3A, the lens cut portion 3F and the lens cut portion 3H are arranged in a mirror image relationship with respect to the vertical plane containing the principal optical axis L of the vehicle lamp. Additionally, as shown in FIG. 3B, the light source 1*a* and the parabolic reflective surface of the reflector 2*a* are arranged in a mirror image relationship with the light source 1*b* and the parabolic reflective surface of the reflector 2*b* with respect to the vertical plane containing the principal optical axis L of the vehicle lamp. Therefore, according to the vehicle lamp of the first exemplary embodiment as shown in FIGS. 3A, 3B, and 3C, the generally parallel light beams coming from the parabolic reflective surface of the reflector 2*b* are diffused by the lens cut portion 3H in the left and right directions and projected as diffused light frontward of the vehicle lamp (leftward in FIG. 3B, upward in FIG. 3C). Furthermore, the generally parallel light beams coming from the parabolic reflective surface of the reflector 2*b* are diffused by the lens cut portion 3H in the up and down directions and projected as diffused light frontward of the vehicle lamp (leftward in FIG. 3B, upward in FIG. 3C).

Furthermore, according to the vehicle lamp of the first exemplary embodiment as shown in FIG. 3A, the lens cut portion 3F and the lens cut portion 3E are arranged in a mirror image relationship with respect to the horizontal plane containing the principal optical axis L of the vehicle lamp. As shown in FIG. 3B, the light source 1*a* and the parabolic reflective surface of the reflector 2*a* are arranged in a mirror image relationship with the light source 1*c* and the parabolic reflective surface of the reflector 2*c* with respect to the horizontal plane containing the principal optical axis L of the vehicle lamp. Therefore, as shown in FIGS. 3A, and 3B, the vehicle lamp of the first exemplary embodiment is configured such that the generally parallel light beams coming from the parabolic reflective surface of the reflector 2*c* are diffused by the lens cut portion 3E in the left and right directions and projected as the diffused light frontward of the vehicle lamp (leftward in FIG. 3B). Furthermore, the generally parallel light beams coming from the parabolic reflective surface of the reflector 2*c* are diffused by the lens cut portion 3E in the up and down directions, and projected as diffused light frontward of the vehicle lamp (leftward in FIG. 3B).

According to the vehicle lamp of the first exemplary embodiment as shown in FIG. 3A, the lens cut portion 3E and the lens cut portion 3G are arranged in a mirror image relationship with respect to the vertical plane containing the principal optical axis L of the vehicle lamp. Furthermore, as shown in FIG. 3B, the light source 1*c* and the parabolic reflective surface of the reflector 2*c* are arranged in a mirror image relationship with the light source 1*d* and the parabolic reflective surface of the reflector 2*d* with respect to the vertical plane containing the principal optical axis L of the vehicle lamp. Therefore, as shown in FIGS. 3A, and 3B, the vehicle lamp of the first exemplary embodiment is configured such that the generally parallel light beams coming from the parabolic reflective surface of the reflector 2*d* are diffused by the lens cut portion 3G in the left and right directions and projected as the diffused light frontward of the vehicle lamp (leftward in FIG. 3B). Furthermore, the generally parallel light beams coming from the parabolic reflective surface of the reflector 2*d* are diffused by the lens cut portion 3G in the up and down directions, and projected as diffused light frontward of the vehicle lamp (leftward in FIG. 3B).

That is, the vehicle lamp of the first exemplary embodiment makes it possible to readily form a light distribution pattern which has left-right symmetry about the vertical plane containing the principal optical axis L of the vehicle lamp and which also has up-down symmetry with respect to the horizontal plane containing the principal optical axis L of the vehicle lamp.

Furthermore, according to the vehicle lamp of the first exemplary embodiment as shown in FIGS. 3A and 3C, the lens cut portions 3A and 3C located on the left side with respect to the valley line 3I and the lens cut portions 3B and 3D located on the right side are coupled to each other at the position of the valley line 3I. That is, there exists no step height in the longitudinal direction (in the direction of depth or in the up and down directions in FIG. 3C of the vehicle lamp between the lens cut portions 3A, 3C located on the left side with respect to the valley line 3I and the lens cut portions 3B, 3D located on the right side.

Also, according to the vehicle lamp of the first exemplary embodiment as shown in FIGS. 3A and 3C, the lens cut portions 3F and 3D located on the left upper side with respect to the valley line 3J and the lens cut portions 3A and 3G located on the right lower side are coupled to each other at the position of the valley line 3J. That is, there exists no step height in the longitudinal direction (in the direction of depth or in the up and down directions in FIG. 3C) of the vehicle lamp between the lens cut portions 3F, 3D located on the left upper side with respect to the valley line 3J and the lens cut portions 3A, 3G located on the right lower side.

Furthermore, according to the vehicle lamp of the first exemplary embodiment as shown in FIG. 3A, the lens cut portions 3E and 3G located on the upper side with respect to the valley line 3K and the lens cut portions 3F and 3H located on the lower side are coupled to each other at the position of the valley line 3K. That is, there exists no step height in the longitudinal direction (in the direction of depth) of the vehicle lamp between the lens cut portions 3E, 3G located on the upper side with respect to the valley line 3K and the lens cut portions 3F, 3H located on the lower side.

Also, according to the vehicle lamp of the first exemplary embodiment as shown in FIGS. 3A and 3C, the lens cut portions 3B and 3E located on the left lower side with respect to the valley line 3L and the lens cut portions 3H and 3C located on the right upper side are coupled to each other at the position of the valley line 3L. That is, there exists no step height in the longitudinal direction (in the direction of depth or in the up and down directions in FIG. 3C) of the vehicle lamp between the lens cut portions 3B, 3E located on the left lower side with respect to the valley line 3L and the lens cut portions 3H, 3C located on the right upper side.

Therefore, even when the lens 3 is formed of a resin material by molding, the vehicle lamp of the first exemplary embodiment allows the lens 3 to be easily taken out of (ejected from) the molding die when compared with the case where there exists a step height in the longitudinal direction (in the direction of depth) of the vehicle lamp between those lens cut portions located on one side of the valley lines 3I, 3J, 3K, and 3L and those lens cut portions located on the other side thereof.

A description will now be made with respect to a vehicle lamp according to a second exemplary embodiment of the presently disclosed subject matter. The vehicle lamp of the second exemplary embodiment is configured generally in the same manner as the vehicle lamp of the first exemplary embodiment described above except for at least the following points. Accordingly, the vehicle lamp of the second exemplary embodiment can provide substantially the same effects as those of the vehicle lamp of the first exemplary embodiment described above.

Figure 6A:
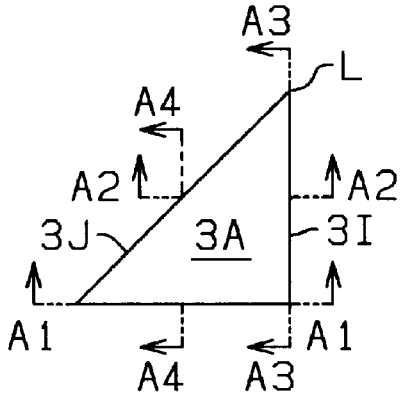
FIGS. 6A, 6B, 6C, 6D, and 6E are views illustrating in detail a lens cut portion 3A of a lens 3 of a vehicle lamp according to a second exemplary embodiment.
Figure 6D:
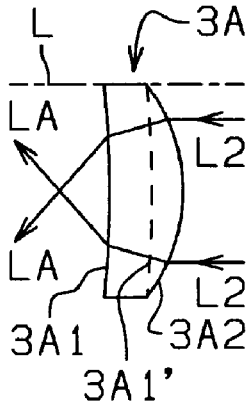
Figure 6E:
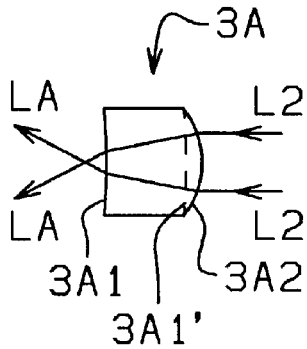
Figure 6B:
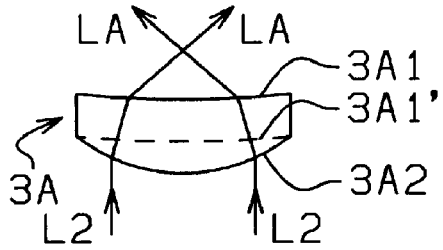
Figure 6C:
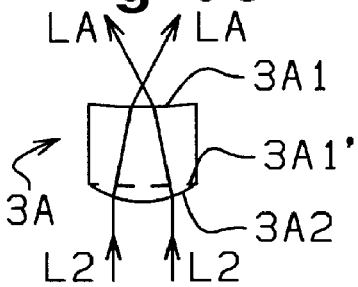

FIGS. 6A to 6E are views illustrating in detail the lens cut portion 3A of the lens 3 according to the vehicle lamp of the second exemplary embodiment. More specifically, FIG. 6A is a front view of the lens cut portion 3A of the lens 3 of the vehicle lamp according to the second exemplary embodiment, FIG. 6B is a cross-sectional view taken along line A1-A1 of FIG. 6A (a lower end face view of the lens cut portion 3A), FIG. 6C is a cross-sectional view taken along line A2-A2 of FIG. 6A, FIG. 6D is a cross-sectional view taken along line A3-A3 of FIG. 6A, and FIG. 6E is a cross-sectional view taken along line A4-A4 of FIG. 6A.

As shown in FIG. 3B, FIG. 3C, FIG. 4B, FIG. 4C, FIG. 4D, and FIG. 4E, the vehicle lamp of the first exemplary embodiment has the light transmitting surface 3A1 of the lens cut portion 3A formed as a flat plane. However, as shown in FIG. 6B, FIG. 6C, FIG. 6D, and FIG. 6E, the vehicle lamp of the second exemplary embodiment is configured such that the light transmitting surface 3A1 of the lens cut portion 3A is formed as a concave surface.

More specifically, within the cross section (horizontal plane) of the vehicle lamp of the second exemplary embodiment shown in FIG. 6B and FIG. 6C, the light incident surface 3A2 of the lens cut portion 3A protrudes rearward of the imaginary plane 3A1' which is defined by offsetting the light transmitting surface 3A1 of the lens cut portion 3A toward the light incident side (downward in FIGS. 6B and 6C, toward the reflector 2*a*). Therefore, in the vehicle lamp of the second exemplary embodiment as shown in FIGS. 6B and 6C, the generally parallel light beams L2 coming from the parabolic reflective surface of the reflector 2*a* (see FIGS. 3B and 3C) are diffused by the lens cut portion 3A in the left and right directions and projected as the diffused light LA frontward of the vehicle lamp (upward in FIGS. 6B and 6C).

More specifically, within the cross section (vertical plane) of the vehicle lamp of the second exemplary embodiment shown in FIG. 6D and FIG. 6E, the light incident surface 3A2 of the lens cut portion 3A protrudes rearward of the imaginary plane 3A1' which is defined by offsetting the light transmitting surface 3A1 of the lens cut portion 3A toward the light incident side (rightward in FIGS. 6B and 6C, toward the reflector 2*a*). Therefore, in the vehicle lamp of the second exemplary embodiment as shown in FIGS. 6D and 6E, the generally parallel light beams L2 coming from the parabolic reflective surface of the reflector 2*a* (see FIGS. 3B and 3C) are diffused by the lens cut portion 3A in the up and down directions and projected as the diffused light LA frontward of the vehicle lamp (leftward in FIGS. 6D and 6E).

Furthermore, according to the vehicle lamp of the second exemplary embodiment as in the vehicle lamp of the first exemplary embodiment shown in FIG. 3A, the lens cut portion 3A and the lens cut portion 3C illustrated in FIG. 6 are arranged in a mirror image relationship with respect to the horizontal plane containing the principal optical axis L of the vehicle lamp. Furthermore, as shown in FIG. 3B, the light source 1*a* and the parabolic reflective surface of the reflector 2*a* are arranged in a mirror image relationship with the light source 1*c* and the parabolic reflective surface of the reflector 2*c* with respect to the horizontal plane containing the principal optical axis L of the vehicle lamp. Furthermore, as shown in FIG. 3A, the lens cut portion 3A and the lens cut portion 3B illustrated in FIG. 6 are arranged in a mirror image relationship with respect to the vertical plane containing the principal optical axis L of the vehicle lamp. Furthermore, as shown in FIG. 3B, the light source 1*a* and the parabolic reflective surface of the reflector 2*a* are arranged in a mirror image relationship with the light source 1*b* and the parabolic reflective surface of the reflector 2*b* with respect to the vertical plane containing the principal optical axis L of the vehicle lamp. Furthermore, as shown in FIG. 3A, the lens cut portion 3B and the lens cut portion 3D are arranged in a mirror image relationship with respect to the horizontal plane containing the principal optical axis L of the vehicle lamp. Furthermore, as shown in FIG. 3B, the light source 1*b* and the parabolic reflective surface of the reflector 2*b* are arranged in a mirror image relationship with the light source 1*d* and the parabolic reflective surface of the reflector 2*d* with respect to the horizontal plane containing the principal optical axis L of the vehicle lamp.

Figure 7C:
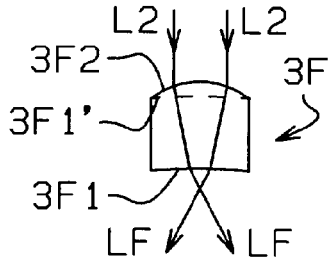
FIGS. 7A, 7B, 7C, 7D, and 7E are views illustrating in detail a lens cut portion 3F of the lens 3 of the vehicle lamp according to the second exemplary embodiment.
Figure 7B:
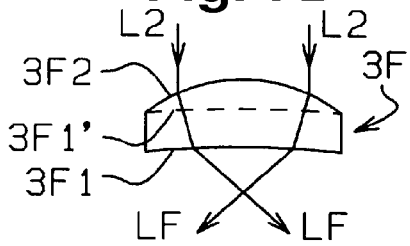
Figure 7E:
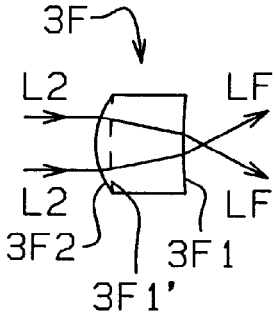
Figure 7D:
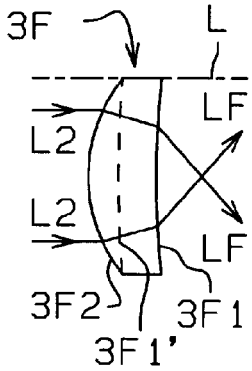
Figure 7A:
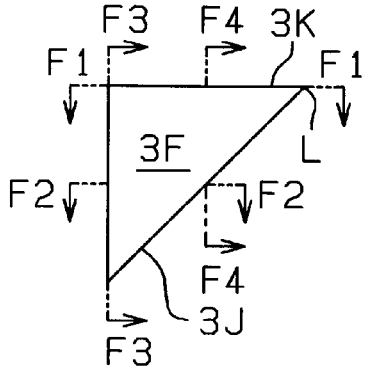

FIGS. 7A to 7E are views illustrating in detail the lens cut portion 3F of the lens 3 of the second exemplary embodiment. More specifically, FIG. 7A is a front view of the lens cut portion 3F of the lens 3, FIG. 7B is a cross-sectional view taken along line F1-F1 of FIG. 7A, and FIG. 7C is a cross-sectional view taken along line F2-F2 of FIG. 7A. FIG. 7D is a cross-sectional view taken along line F3-F3 of FIG. 7A (a view showing the left end face of the lens cut portion 3F), and FIG. 7E is a cross-sectional view taken along line F4-F4 of FIG. 7A.

As shown in FIG. 3B, FIG. 3C, FIG. 5B, FIG. 5C, FIG. 5D, and FIG. 5E, the vehicle lamp of the first exemplary embodiment has a light transmitting surface 3F1 of the lens cut portion 3F formed as a flat plane. However, as shown in FIG. 7B, FIG. 7C, FIG. 7D, and FIG. 7E, the vehicle lamp of the second exemplary embodiment is configured such that the light transmitting surface 3F1 of the lens cut portion 3F is formed as a concave surface.

More specifically, within the cross section (horizontal plane) of the vehicle lamp of the second exemplary embodiment shown in FIG. 7B and FIG. 7C, the light incident surface 3F2 of the lens cut portion 3F protrudes rearward of the imaginary plane 3F1' which is defined by offsetting the light transmitting surface 3F1 of the lens cut portion 3F toward the light incident side (upward in FIGS. 7B and 7C, toward the reflector 2*a*). Therefore, in the vehicle lamp of the second exemplary embodiment as shown in FIGS. 7B and 7C, the generally parallel light beams L2 coming from the parabolic reflective surface of the reflector 2*a* (see FIGS. 3B and 3C) are diffused by the lens cut portion 3F in the left and right directions and projected as the diffused light LF frontward of the vehicle lamp (downward in FIGS. 7B and 7C).

More specifically, within the cross section (vertical plane) of the vehicle lamp of the second exemplary embodiment shown in FIG. 7D and FIG. 7E, the light incident surface 3F2 of the lens cut portion 3F protrudes rearward of the imaginary plane 3F1' which is defined by offsetting the light transmitting surface 3F1 of the lens cut portion 3F toward the light incident side (leftward in FIGS. 7D and 7E, toward the reflector 2*a*). Therefore, in the vehicle lamp of the second exemplary embodiment as shown in FIGS. 7D and 7E, the generally parallel light beams L2 coming from the parabolic reflective surface of the reflector 2*a* (see FIGS. 3B and 3C) are diffused by the lens cut portion 3F in the up and down directions and projected as the diffused light LF frontward of the vehicle lamp (rightward in FIGS. 7D and 7E).

Furthermore, according to the vehicle lamp of the second exemplary embodiment as in the vehicle lamp of the first exemplary embodiment shown in FIG. 3A, the lens cut portion 3F and the lens cut portion 3H illustrated in FIGS. 7A to 7E are arranged in a mirror image relationship with respect to the vertical plane containing the principal optical axis L of the vehicle lamp. Furthermore, as shown in FIG. 3B, the light source 1*a* and the parabolic reflective surface of the reflector 2*a* are arranged in a mirror image relationship with the light source 1*b* and the parabolic reflective surface of the reflector 2*b* with respect to the vertical plane containing the principal optical axis L of the vehicle lamp. Furthermore, as shown in FIG. 3A, the lens cut portion 3F and the lens cut portion 3E illustrated in FIG. 7 are arranged in a mirror image relationship with respect to the horizontal plane containing the principal optical axis L of the vehicle lamp. Furthermore, as shown in FIG. 3B, the light source 1*a* and the parabolic reflective surface of the reflector 2*a* are arranged in a mirror image relationship with the light source 1*c* and the parabolic reflective surface of the reflector 2*c* with respect to the horizontal plane containing the principal optical axis L of the vehicle lamp. Furthermore, as shown in FIG. 3A, the lens cut portion 3E and the lens cut portion 3G are arranged in a mirror image relationship with respect to the vertical plane containing the principal optical axis L of the vehicle lamp. Furthermore, as shown in FIG. 3B, the light source 1*c* and the parabolic reflective surface of the reflector 2*c* are arranged in a mirror image relationship with the light source 1*d* and the parabolic reflective surface of the reflector 2*d* with respect to the vertical plane containing the principal optical axis L of the vehicle lamp.

A description will now be made with respect to a vehicle lamp according to a third exemplary embodiment of the presently disclosed subject matter. The vehicle lamp of the third exemplary embodiment is configured generally in the same manner as the vehicle lamp of the first exemplary embodiment described above except for at least the following points. Accordingly, the vehicle lamp of the third exemplary embodiment can provide substantially the same effects as those of the vehicle lamp of the first exemplary embodiment described above.

Figure 8A:
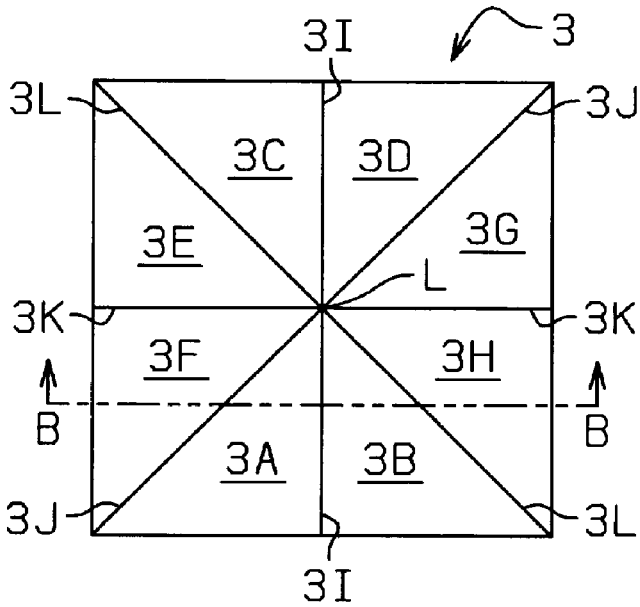
FIGS. 8A and 8B are views illustrating a vehicle lamp of a third exemplary embodiment.
Figure 8B:
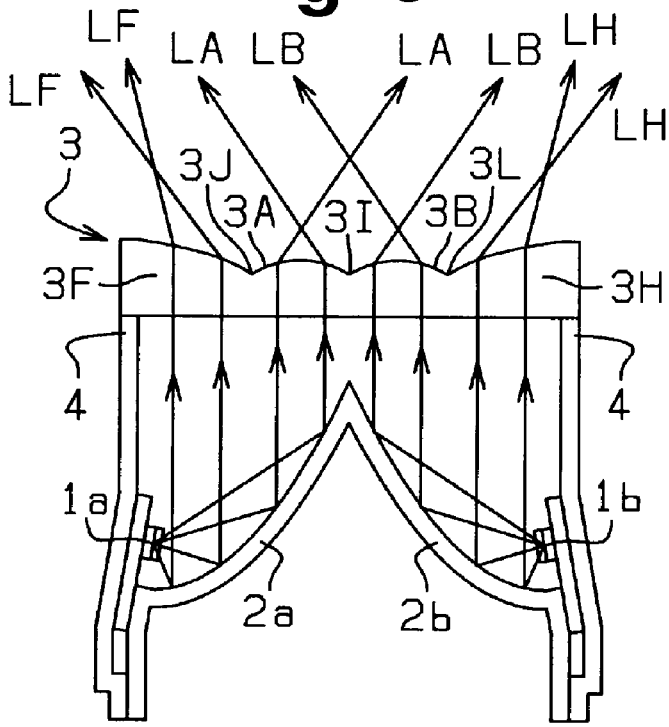

FIGS. 8A and 8B are views illustrating the vehicle lamp of the third exemplary embodiment. More specifically, FIG. 8A is a front view of the vehicle lamp of the third exemplary embodiment, and FIG. 8B is a cross-sectional view taken along line B-B of FIG. 8B.

Figure 9A:
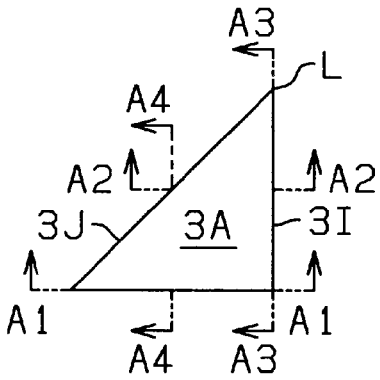
FIGS. 9A, 9B, 9C, 9D, and 9E are views illustrating in detail a lens cut portion 3A of a lens 3 of the vehicle lamp according to the third exemplary embodiment.
Figure 9D:
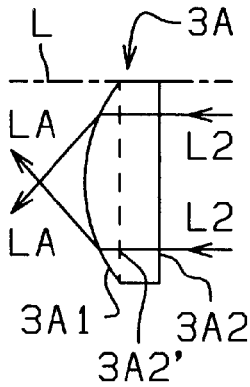
Figure 9E:
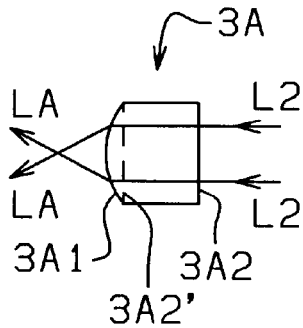
Figure 9B:
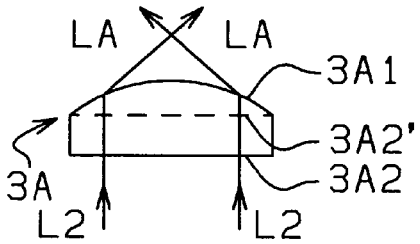
Figure 9C:
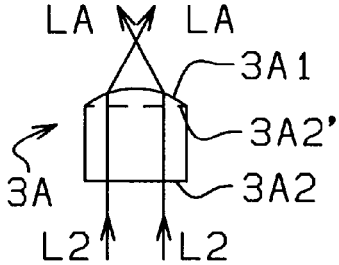

FIGS. 9A to 9E are views illustrating in detail the lens cut portion 3A of the lens 3 according to the vehicle lamp of the third exemplary embodiment. More specifically, FIG. 9A is a front view of the lens cut portion 3A of the lens 3 of the vehicle lamp according to the third exemplary embodiment, FIG. 9B is a cross-sectional view taken along line A1-A1 of FIG. 9A (a lower end face view of the lens cut portion 3A), FIG. 9C is a cross-sectional view taken along line A2-A2 of FIG. 9A, FIG. 9D is a cross-sectional view taken along line A3-A3 of FIG. 9A, and FIG. 9E is a cross-sectional view taken along line A4-A4 of FIG. 9A.

As shown in FIG. 3B, FIG. 3C, FIG. 4B, FIG. 4C, FIG. 4D, and FIG. 4E, the vehicle lamp of the first exemplary embodiment is configured such that the light transmitting surface 3A1 of the lens cut portion 3A is formed on a flat plane, and the light incident surface 3A2 of the lens cut portion 3A is formed to have a convex surface. In contrast to this, as shown in FIG. 8B, FIG. 9B, FIG. 9C, FIG. 9D, and FIG. 9E, the vehicle lamp of the third exemplary embodiment is configured such that the light transmitting surface 3A1 of the lens cut portion 3A is formed to have a convex surface, while the light incident surface 3A2 of the lens cut portion 3A is formed to have a flat plane or a concave surface.

More specifically, within the cross section (horizontal plane) of the vehicle lamp of the third exemplary embodiment as shown in FIG. 9B and FIG. 9C, the light transmitting surface 3A1 of the lens cut portion 3A protrudes frontward of an imaginary plane 3A2' which is defined by offsetting the light incident surface 3A2 of the lens cut portion 3A toward the light incident side (upward in FIGS. 9B and 9C, opposite to the reflector 2*a*). Therefore, in the vehicle lamp of the third exemplary embodiment as shown in FIGS. 9B and 9C, the generally parallel light beams L2 coming from the parabolic reflective surface of the reflector 2*a* (see FIGS. 8B and 3B) are diffused by the lens cut portion 3A in the left and right directions and projected as diffused light LA frontward of the vehicle lamp (upward in FIGS. 9B and 9C).

More specifically, within the cross section (vertical plane) of the vehicle lamp of the third exemplary embodiment as shown in FIG. 9D and FIG. 9E, the light transmitting surface 3A1 of the lens cut portion 3A protrudes frontward of an imaginary plane 3A2' which is defined by offsetting the light incident surface 3A2 of the lens cut portion 3A toward the light incident side (leftward in FIGS. 9D and 9E, opposite to the reflector 2*a*). Therefore, in the vehicle lamp of the third exemplary embodiment as shown in FIGS. 9D and 9E, the generally parallel light beams L2 coming from the parabolic reflective surface of the reflector 2*a* (see FIGS. 8B and 3B) are diffused by the lens cut portion 3A in the up and down directions and projected as the diffused light LA frontward of the vehicle lamp (leftward in FIGS. 9D and 9E).

Furthermore, according to the vehicle lamp of the third exemplary embodiment as in the vehicle lamp of the first exemplary embodiment shown in FIG. 8A, the lens cut portion 3A and the lens cut portion 3C illustrated in FIGS. 9A to 9E are arranged in a mirror image relationship with respect to the horizontal plane containing the principal optical axis L of the vehicle lamp. Furthermore, as shown in FIG. 3B, the light source 1*a* and the parabolic reflective surface of the reflector 2*a* are arranged in a mirror image relationship with the light source 1*c* and the parabolic reflective surface of the reflector 2*c* with respect to the horizontal plane containing the principal optical axis L of the vehicle lamp. Furthermore, as shown in FIG. 8A, the lens cut portion 3A and the lens cut portion 3B illustrated in FIG. 9 are arranged in a mirror image relationship with respect to the vertical plane containing the principal optical axis L of the vehicle lamp. Furthermore, as shown in FIG. 3B, the light source 1*a* and the parabolic reflective surface of the reflector 2*a* are arranged in a mirror image relationship with the light source 1*b* and the parabolic reflective surface of the reflector 2*b* with respect to the vertical plane containing the principal optical axis L of the vehicle lamp. Furthermore, as shown in FIG. 8A, the lens cut portion 3B and the lens cut portion 3D are arranged in a mirror image relationship with respect to the horizontal plane containing the principal optical axis L of the vehicle lamp. Furthermore, as shown in FIG. 3B, the light source 1*b* and the parabolic reflective surface of the reflector 2*b* are arranged in a mirror image relationship with the light source 1*d* and the parabolic reflective surface of the reflector 2*d* with respect to the horizontal plane containing the principal optical axis L of the vehicle lamp.

Figure 10C:
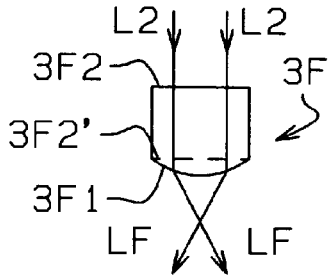
FIGS. 10A, 10B, 10C, 10D, and 10E are views illustrating in detail a lens cut portion 3F of the lens 3 of the vehicle lamp according to the third exemplary embodiment.
Figure 10B:
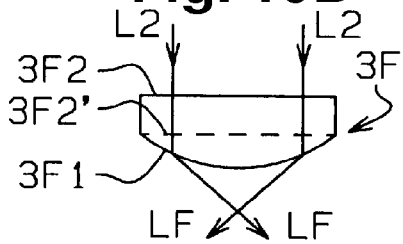
Figure 10E:
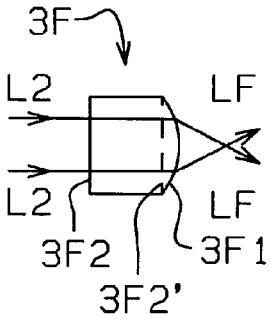
Figure 10D:
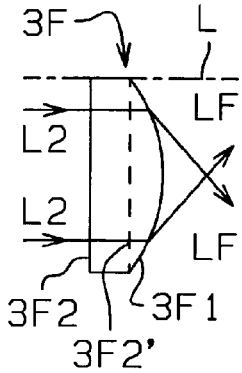
Figure 10A:
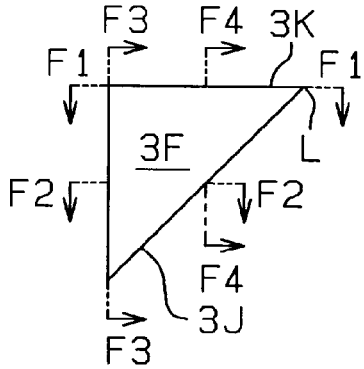

FIGS. 10A to 10E are views illustrating in detail the lens cut portion 3F of lens 3 of the third exemplary embodiment. More specifically, FIG. 10A is a front view of the lens cut portion 3F of the lens 3 according to the vehicle lamp, FIG. 10B is a cross-sectional view taken along line F1-F1 of FIG. 10A, and FIG. 10C is a cross-sectional view taken along line F2-F2 of FIG. 10A. FIG. 10D is a cross-sectional view taken along line F3-F3 of FIG. 10A (a view showing the left end face of the lens cut portion 3F), and FIG. 10E is a cross-sectional view taken along line F4-F4 of FIG. 10A.

As shown in FIG. 3B, FIG. 3C, FIG. 5B, FIG. 5C, FIG. 5D, and FIG. 5E, the vehicle lamp of the first exemplary embodiment is configured such that the light transmitting surface 3F1 of the lens cut portion 3F is formed on a flat plane, while the light incident surface 3F2 of the lens cut portion 3F is formed to have a convex surface. In contrast to this, as shown in FIG. 8B, FIG. 10B, FIG. 10C, FIG. 10D, and FIG. 10E, the vehicle lamp of the third exemplary embodiment is configured such that the light transmitting surface 3F1 of the lens cut portion 3F is formed to have a convex surface, while the light incident surface 3F2 of the lens cut portion 3F is formed to have a flat plane or concave surface.

More specifically, within the cross section (horizontal plane) of the vehicle lamp of the third exemplary embodiment shown in FIG. 10B and FIG. 10C, the light transmitting surface 3F1 of the lens cut portion 3F protrudes frontward of an imaginary plane 3F2' which is defined by offsetting a light incident surface 3F2 of the lens cut portion 3F toward a light transmitting side (downward in FIGS. 10B and 10C, opposite to the reflector 2*a*). Therefore, in the vehicle lamp of the third exemplary embodiment as shown in FIGS. 10B and 10C, generally parallel light beams L2 coming from the parabolic reflective surface of the reflector 2*a* (see FIGS. 8B and 3B) are diffused by the lens cut portion 3F in the left and right directions and then projected as the diffused light LF frontward of the vehicle lamp (downward in FIGS. 10B and 10C).

Furthermore, within the cross section (vertical plane) of the vehicle lamp of the third exemplary embodiment as shown in FIG. 10D and FIG. 10E, the light transmitting surface 3F1 of the lens cut portion 3F protrudes frontward of the imaginary plane 3F2' which is defined by offsetting the light incident surface 3F2 of the lens cut portion 3F toward the light transmitting side (rightward in FIGS. 10D and 10E, opposite to the reflector 2*a*). Therefore, in the vehicle lamp of the third exemplary embodiment as shown in FIGS. 10D and 10E, the generally parallel light beams L2 coming from the parabolic reflective surface of the reflector 2*a* (see FIGS. 8B and 3B) are diffused by the lens cut portion 3F in the up and down directions and projected as the diffused light LF frontward of the vehicle lamp (rightward in FIGS. 10D and 10E).

Furthermore, according to the vehicle lamp of the third exemplary embodiment as in the vehicle lamp of the first exemplary embodiment shown in FIG. 8A, the lens cut portion 3F and the lens cut portion 3H illustrated in FIGS. 10A to 10E are arranged in a mirror image relationship with respect to the vertical plane containing the principal optical axis L of the vehicle lamp. Furthermore, as shown in FIG. 3B, the light source 1*a* and the parabolic reflective surface of the reflector 2*a* are arranged in a mirror image relationship with the light source 1*b* and the parabolic reflective surface of the reflector 2*b* with respect to the vertical plane containing the principal optical axis L of the vehicle lamp. Furthermore, as shown in FIG. 8A, the lens cut portion 3F and the lens cut portion 3E illustrated in FIGS. 10A to 10E are arranged in a mirror image relationship with respect to the horizontal plane containing the principal optical axis L of the vehicle lamp. Furthermore, as shown in FIG. 3B, the light source 1*a* and the parabolic reflective surface of the reflector 2*a* are arranged in a mirror image relationship with the light source 1*c* and the parabolic reflective surface of the reflector 2*c* with respect to the horizontal plane containing the principal optical axis L of the vehicle lamp. Furthermore, as shown in FIG. 8A, the lens cut portion 3E and the lens cut portion 3G are arranged in a mirror image relationship with respect to the vertical plane containing the principal optical axis L of the vehicle lamp. Furthermore, as shown in FIG. 3B, the light source 1*c* and the parabolic reflective surface of the reflector 2*c* are arranged in a mirror image relationship with the light source 1*d* and the parabolic reflective surface of the reflector 2*d* with respect to the vertical plane containing the principal optical axis L of the vehicle lamp.

A description will now be made with respect to a vehicle lamp according to a fourth exemplary embodiment of the presently disclosed subject matter. The vehicle lamp of the fourth exemplary embodiment is configured generally in the same manner as the vehicle lamp of the first exemplary embodiment described above except for at least the following points. Accordingly, the vehicle lamp of the fourth exemplary embodiment can provide substantially the same effects as those of the vehicle lamp of the first exemplary embodiment described above.

Figure 11A:
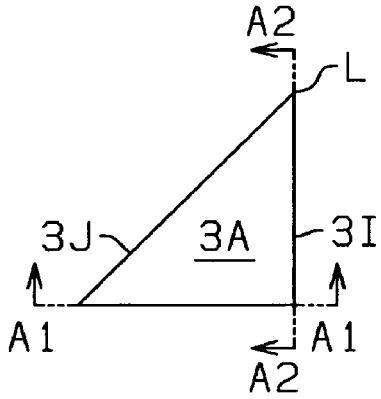
FIGS. 11A, 11B, and 11C are views illustrating in detail a lens cut portion 3A of a lens 3 of a vehicle lamp according to a fourth exemplary embodiment.
Figure 11C:
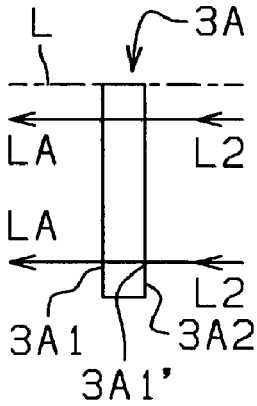
Figure 11B:
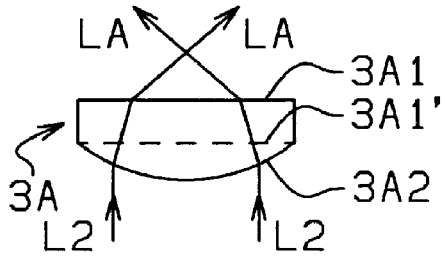

FIGS. 11A to 11C are views illustrating in detail the lens cut portion 3A of the lens 3 according to the vehicle lamp of the fourth exemplary embodiment. More specifically, FIG. 11A is a front view of the lens cut portion 3A of the lens 3 of the vehicle lamp according to the fourth exemplary embodiment, FIG. 11B is a cross-sectional view taken along line A1-A1 of FIG. 11A (a lower end face view of the lens cut portion 3A), and FIG. 11C is a cross-sectional view taken along line A2-A2 of FIG. 11A.

More specifically, within the cross section (horizontal plane) of the vehicle lamp of the fourth exemplary embodiment as shown in FIG. 11B, the light incident surface 3A2 of the lens cut portion 3A protrudes rearward of an imaginary plane 3A1' which is defined by offsetting the light transmitting surface 3A1 of the lens cut portion 3A toward the light incident side (downward in FIG. 11B, toward the reflector 2*a*). Therefore, in the vehicle lamp of the fourth exemplary embodiment as shown in FIG. 11B as in the first exemplary embodiment shown in FIG. 4B, the generally parallel light beams L2 coming from the parabolic reflective surface of the reflector 2*a* (see FIGS. 3B and 3C) are diffused by the lens cut portion 3A in the left and right directions and projected as the diffused light LA frontward of the vehicle lamp (upward in FIG. 11B).

On the other hand, within the cross section (vertical plane) of the vehicle lamp of the first exemplary embodiment shown in FIG. 4D and FIG. 4E, the light incident surface 3A2 of the lens cut portion 3A protrudes rearward of the imaginary plane 3A1' which is defined by offsetting the light transmitting surface 3A1 of the lens cut portion 3A toward the light incident side (rightward in FIGS. 4D and 4E, toward the reflector 2*a*). In contrast to this, within the cross section (vertical plane) of the vehicle lamp of the fourth exemplary embodiment shown in FIG. 11C, the light incident surface 3A2 of the lens cut portion 3A is aligned with the imaginary plane 3A1' which is defined by offsetting the light transmitting surface 3A1 of the lens cut portion 3A toward the light incident side (rightward in FIG. 11C, toward the reflector 2*a*). Therefore, in the vehicle lamp of the fourth exemplary embodiment as shown in FIG. 11C, the generally parallel light beams L2 coming from the parabolic reflective surface of the reflector 2*a* (see FIGS. 3B and 3C) will not be diffused by the lens cut portion 3A in the up and down directions but projected frontward of the vehicle lamp (leftward in FIG. 11C) as light LA traveling across a horizontal plane.

Furthermore, like the vehicle lamp of the first exemplary embodiment, the vehicle lamp of the fourth exemplary embodiment as shown in FIG. 3A is configured such that the lens cut portion 3A and the lens cut portion 3C are arranged in a mirror image relationship with respect to the horizontal plane containing the principal optical axis L of the vehicle lamp. Furthermore, as shown in FIG. 3B, the light source 1*a* and the parabolic reflective surface of the reflector 2*a* are arranged in a mirror image relationship with the light source 1*c* and the parabolic reflective surface of the reflector 2*c* with respect to the horizontal plane containing the principal optical axis L of the vehicle lamp. Therefore, like the vehicle lamp of the first exemplary embodiment, the vehicle lamp of the fourth exemplary embodiment is configured such that the generally parallel light beams coming from the parabolic reflective surface of the reflector 2*c* are diffused by the lens cut portion 3C in the left and right directions and projected as diffused light frontward of the vehicle lamp (leftward in FIG. 3B). On the other hand, unlike the vehicle lamp of the first exemplary embodiment, the vehicle lamp of the fourth exemplary embodiment is configured such that the generally parallel light beams coming from the parabolic reflective surface of the reflector 2*c* will not be diffused by the lens cut portion 3C in the up and down directions but projected frontward of the vehicle lamp (leftward in FIG. 3B) as light traveling across a horizontal plane.

Furthermore, according to the vehicle lamp of the fourth exemplary embodiment as in the vehicle lamp of the first exemplary embodiment shown in FIG. 3A, the lens cut portion 3A and the lens cut portion 3B are arranged in a mirror image relationship with respect to the vertical plane containing the principal optical axis L of the vehicle lamp. Furthermore, as shown in FIGS. 3B and 3C, the light source 1*a* and the parabolic reflective surface of the reflector 2*a* are arranged in a mirror image relationship with the light source 1*b* and the parabolic reflective surface of the reflector 2*b* with respect to the vertical plane containing the principal optical axis L of the vehicle lamp. Therefore, like the vehicle lamp of the first exemplary embodiment, the vehicle lamp of the fourth exemplary embodiment is configured such that the generally parallel light beams coming from the parabolic reflective surface of the reflector 2*b* are diffused by the lens cut portion 3B in the left and right directions and projected as diffused light LB frontward of the vehicle lamp (leftward in FIG. 3B, upward in FIG. 3C). On the other hand, unlike the vehicle lamp of the first exemplary embodiment, the vehicle lamp of the fourth exemplary embodiment is configured such that the generally parallel light beams coming from the parabolic reflective surface of the reflector 2*b* will not be diffused by the lens cut portion 3B in the up and down directions but projected frontward of the vehicle lamp (leftward in FIG. 3B, upward in FIG. 3C) as light LB traveling across a horizontal plane.

Furthermore, according to the vehicle lamp of the fourth exemplary embodiment as in the vehicle lamp of the first exemplary embodiment shown in FIG. 3A, the lens cut portion 3B and the lens cut portion 3D are arranged in a mirror image relationship with respect to the horizontal plane containing the principal optical axis L of the vehicle lamp. Furthermore, as shown in FIG. 3B, the light source 1*b* and the parabolic reflective surface of the reflector 2*b* are arranged in a mirror image relationship with the light source 1*d* and the parabolic reflective surface of the reflector 2*d* with respect to the horizontal plane containing the principal optical axis L of the vehicle lamp. Therefore, like the vehicle lamp of the first exemplary embodiment, the vehicle lamp of the fourth exemplary embodiment is configured such that the generally parallel light beams coming from the parabolic reflective surface of the reflector 2*d* are diffused by the lens cut portion 3D in the left and right directions and projected as diffused light frontward of the vehicle lamp (leftward in FIG. 3B). On the other hand, unlike the vehicle lamp of the first exemplary embodiment, the vehicle lamp of the fourth exemplary embodiment is configured such that the generally parallel light beams coming from the parabolic reflective surface of the reflector 2*d* will not be diffused by the lens cut portion 3D in the up and down directions but projected frontward of the vehicle lamp (leftward in FIG. 3B) as light traveling across a horizontal plane.

Figure 12B:
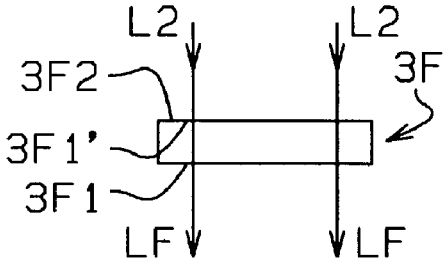
FIGS. 12A, 12B, and 12C are views illustrating in detail a lens cut portion 3F of the lens 3 of the vehicle lamp according to the fourth exemplary embodiment.
Figure 12C:
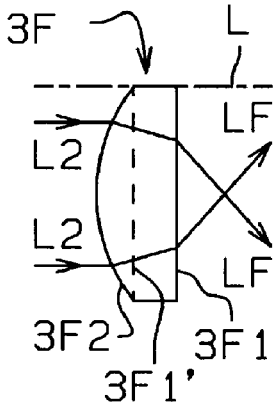
Figure 12A:
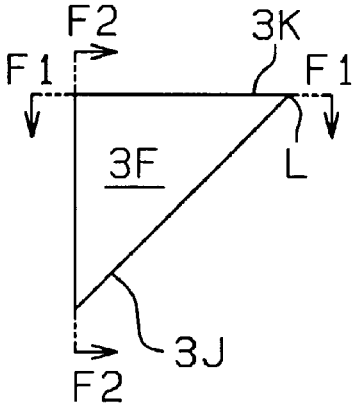

FIGS. 12A to 12C are views illustrating in detail the lens cut portion 3F of the lens 3 according to the vehicle lamp of the fourth exemplary embodiment. More specifically, FIG. 12A is a front view of the lens cut portion 3F of the lens 3 of the vehicle lamp according to the fourth exemplary embodiment, FIG. 12B is a cross-sectional view taken along line F1-F1 of FIG. 12A, and FIG. 12C is a cross-sectional view taken along line F2-F2 of FIG. 12A (a left end face view of the lens cut portion 3F).

More specifically, within the cross section (vertical plane) of the vehicle lamp of the fourth exemplary embodiment as shown in FIG. 12C, the light incident surface 3F2 of the lens cut portion 3F protrudes rearward of an imaginary plane 3F1' which is defined by offsetting the light transmitting surface 3F1 of the lens cut portion 3F toward the light incident side (leftward in FIG. 12C, toward the reflector 2*a*). Therefore, in the vehicle lamp of the fourth exemplary embodiment as shown in FIG. 12C as in the first exemplary embodiment shown in FIG. 5D, the generally parallel light beams L2 coming from the parabolic reflective surface of the reflector 2*a* (see FIGS. 3B and 3C) are diffused by the lens cut portion 3F in the up and down directions and projected as the diffused light LF frontward of the vehicle lamp (leftward in FIG. 12C).

On the other hand, within the cross section (horizontal plane) of the vehicle lamp of the first exemplary embodiment shown in FIG. 5B and FIG. 5C, the light incident surface 3F2 of the lens cut portion 3F protrudes rearward of the imaginary plane 3F1' which is defined by offsetting the light transmitting surface 3F1 of the lens cut portion 3F toward the light incident side (upward in FIGS. 5B and 5C, toward the reflector 2*a*). In contrast to this, within the cross section (horizontal plane) of the vehicle lamp of the fourth exemplary embodiment shown in FIG. 12B, the light incident surface 3F2 of the lens cut portion 3F is aligned with the imaginary plane 3F1' which is defined by offsetting the light transmitting surface 3F1 of the lens cut portion 3F toward the light incident side (upward in FIG. 12B, toward the reflector 2*a*). Therefore, in the vehicle lamp of the fourth exemplary embodiment as shown in FIG. 12B, the generally parallel light beams L2 coming from the parabolic reflective surface of the reflector 2*a* (see FIGS. 3B and 3C) will not be diffused by the lens cut portion 3F in the left and right directions but projected frontward of the vehicle lamp (downward in FIG. 12B) as light LF traveling across a vertical plane.

Furthermore, like the vehicle lamp of the first exemplary embodiment, the vehicle lamp of the fourth exemplary embodiment as shown in FIG. 3A is configured such that the lens cut portion 3F and the lens cut portion 3H are arranged in a mirror image relationship with respect to the vertical plane containing the principal optical axis L of the vehicle lamp. Furthermore, as shown in FIG. 3B, the light source 1*a* and the parabolic reflective surface of the reflector 2*a* are arranged in a mirror image relationship with the light source 1*b* and the parabolic reflective surface of the reflector 2*b* with respect to the vertical plane containing the principal optical axis L of the vehicle lamp. Therefore, like the vehicle lamp of the first exemplary embodiment, the vehicle lamp of the fourth exemplary embodiment is configured such that the generally parallel light beams coming from the parabolic reflective surface of the reflector 2*b* are diffused by the lens cut portion 3H in the up and down directions and projected as diffused light frontward of the vehicle lamp (leftward in FIG. 3B). On the other hand, unlike the vehicle lamp of the first exemplary embodiment, the vehicle lamp of the fourth exemplary embodiment is configured such that the generally parallel light beams coming from the parabolic reflective surface of the reflector 2*b* will not be diffused by the lens cut portion 3H in the left and right directions but projected frontward of the vehicle lamp (leftward in FIG. 3B) as light traveling across a vertical plane.

Furthermore, according to the vehicle lamp of the fourth exemplary embodiment as in the vehicle lamp of the first exemplary embodiment shown in FIG. 3A, the lens cut portion 3F and the lens cut portion 3E are arranged in a mirror image relationship with respect to the horizontal plane containing the principal optical axis L of the vehicle lamp. Furthermore, as shown in FIGS. 3B and 3C, the light source 1*a* and the parabolic reflective surface of the reflector 2*a* are arranged in a mirror image relationship with the light source 1*c* and the parabolic reflective surface of the reflector 2*c* with respect to the horizontal plane containing the principal optical axis L of the vehicle lamp. Therefore, like the vehicle lamp of the first exemplary embodiment, the vehicle lamp of the fourth exemplary embodiment is configured such that the generally parallel light beams coming from the parabolic reflective surface of the reflector 2*c* are diffused by the lens cut portion 3E in the up and down directions and projected as diffused light frontward of the vehicle lamp (leftward in FIG. 3B). On the other hand, unlike the vehicle lamp of the first exemplary embodiment, the vehicle lamp of the fourth exemplary embodiment is configured such that the generally parallel light beams coming from the parabolic reflective surface of the reflector 2*c* will not be diffused by the lens cut portion 3E in the left and right directions but projected frontward of the vehicle lamp (leftward in FIG. 3B) as light traveling across a vertical plane.

Furthermore, according to the vehicle lamp of the fourth exemplary embodiment as in the vehicle lamp of the first exemplary embodiment shown in FIG. 3A, the lens cut portion 3E and the lens cut portion 3G are arranged in a mirror image relationship with respect to the vertical plane containing the principal optical axis L of the vehicle lamp. Furthermore, as shown in FIG. 3B, the light source 1*c* and the parabolic reflective surface of the reflector 2*c* are arranged in a mirror image relationship with the light source 1*d* and the parabolic reflective surface of the reflector 2*d* with respect to the vertical plane containing the principal optical axis L of the vehicle lamp. Therefore, like the vehicle lamp of the first exemplary embodiment, the vehicle lamp of the fourth exemplary embodiment is configured such that the generally parallel light beams coming from the parabolic reflective surface of the reflector 2*d* are diffused by the lens cut portion 3G in the up and down directions and projected as diffused light frontward of the vehicle lamp (leftward in FIG. 3B). On the other hand, unlike the vehicle lamp of the first exemplary embodiment, the vehicle lamp of the fourth exemplary embodiment is configured such that the generally parallel light beams coming from the parabolic reflective surface of the reflector 2*d* will not be diffused by the lens cut portion 3G in the left and right directions but projected frontward of the vehicle lamp (leftward in FIG. 3B) as light traveling across a vertical plane.

A description will now be made with respect to a vehicle lamp according to a fifth exemplary embodiment of the presently disclosed subject matter. The vehicle lamp of the fifth exemplary embodiment is configured generally in the same manner as the vehicle lamp of the fourth exemplary embodiment described above except for at least the following points. Accordingly, the vehicle lamp of the fifth exemplary embodiment can provide substantially the same effects as those of the vehicle lamp of the fourth exemplary embodiment described above.

Figure 13A:
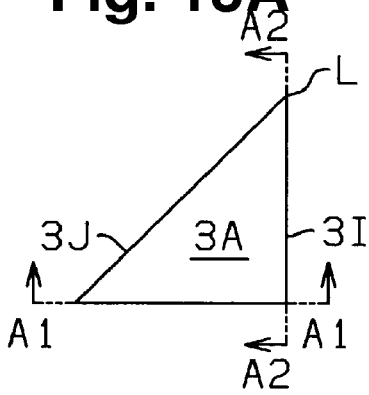
FIGS. 13A, 13B, and 13C are views illustrating in detail a lens cut portion 3A of a lens 3 of a vehicle lamp according to a fifth exemplary embodiment.
Figure 13C:
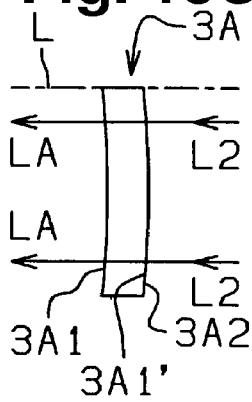
Figure 13B:
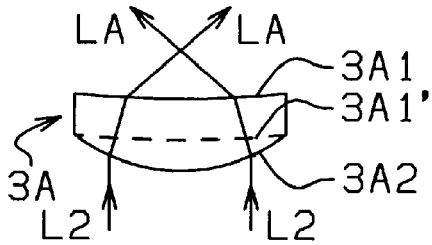

FIGS. 13A to 13C are views illustrating in detail the lens cut portion 3A of the lens 3 according to the vehicle lamp of the fifth exemplary embodiment. More specifically, FIG. 13A is a front view of the lens cut portion 3A of the lens 3 of the vehicle lamp according to the fifth exemplary embodiment, FIG. 13B is a cross-sectional view taken along line A1-A1 of FIG. 13A (a lower end face view of the lens cut portion 3A), and FIG. 13C is a cross-sectional view taken along line A2-A2 of FIG. 13A.

The vehicle lamp of the fourth exemplary embodiment as shown in FIGS. 11B and 11C is configured such that the light transmitting surface 3A1 of the lens cut portion 3A is formed to have a flat plane. In contrast to this, as shown in FIGS. 13B and 13C, the vehicle lamp of the fifth exemplary embodiment is configured such that the light transmitting surface 3A1 of the lens cut portion 3A is formed to have a concave surface.

More specifically, as within the cross section (horizontal plane) of the vehicle lamp of the fourth exemplary embodiment shown in FIG. 11B, within the cross section (horizontal plane) of the vehicle lamp of the fifth exemplary embodiment shown in FIG. 13B, the light incident surface 3A2 of the lens cut portion 3A protrudes rearward of the imaginary plane 3A1' which is defined by offsetting the light transmitting surface 3A1 of the lens cut portion 3A toward the light incident side (downward in FIG. 13B, toward the reflector 2*a*). Therefore, like the vehicle lamp of the fourth exemplary embodiment, the vehicle lamp of the fifth exemplary embodiment as shown in FIG. 13B is configured such that the generally parallel light beams L2 coming from the parabolic reflective surface of the reflector 2*a* (see FIGS. 3B and 3C) are diffused by the lens cut portion 3A in the left and right directions and projected as the diffused light LA frontward of the vehicle lamp (upward in FIG. 13B).

Furthermore, as within the cross section (vertical plane) of the vehicle lamp of the fourth exemplary embodiment shown in FIG. 11C, the cross section (vertical plane) of the vehicle lamp of the fifth exemplary embodiment shown in FIG. 13C shows the light incident surface 3A2 of the lens cut portion 3A aligned with the imaginary plane 3A1' which is defined by offsetting the light transmitting surface 3A1 of the lens cut portion 3A toward the light incident side (rightward in FIG. 13C, toward the reflector 2*a*). Therefore, like the vehicle lamp of the fourth exemplary embodiment, the vehicle lamp of the fifth exemplary embodiment as shown in FIG. 13C is configured such that the generally parallel light beams L2 coming from the parabolic reflective surface of the reflector 2*a* (see FIGS. 3B and 3C) will not be diffused by the lens cut portion 3A in the up and down directions but projected as light LA traveling across a horizontal plane frontward of the vehicle lamp (leftward in FIG. 13C).

Furthermore, according to the vehicle lamp of the fifth exemplary embodiment as in the vehicle lamp of the fourth exemplary embodiment shown in FIG. 3A, the lens cut portion 3A illustrated in FIGS. 13A to 13C and the lens cut portion 3C are arranged in a mirror image relationship with respect to the horizontal plane containing the principal optical axis L of the vehicle lamp. Furthermore, as shown in FIG. 3B, the light source 1*a* and the parabolic reflective surface of the reflector 2*a* are arranged in a mirror image relationship with the light source 1*c* and the parabolic reflective surface of the reflector 2*c* with respect to the horizontal plane containing the principal optical axis L of the vehicle lamp. Furthermore, as shown in FIG. 3A, the lens cut portion 3A illustrated in FIGS. 13A to 13C and the lens cut portion 3B are arranged in a mirror image relationship with respect to the vertical plane containing the principal optical axis L of the vehicle lamp. Furthermore, as shown in FIG. 3B, the light source 1*a* and the parabolic reflective surface of the reflector 2*a* are arranged in a mirror image relationship with the light source 1*b* and the parabolic reflective surface of the reflector 2*b* with respect to the vertical plane containing the principal optical axis L of the vehicle lamp. Furthermore, as shown in FIG. 3A, the lens cut portion 3B and the lens cut portion 3D are arranged in a mirror image relationship with respect to the horizontal plane containing the principal optical axis L of the vehicle lamp. Furthermore, as shown in FIG. 3B, the light source 1*b* and the parabolic reflective surface of the reflector 2*b* are arranged in a mirror image relationship with the light source 1*d* and the parabolic reflective surface of the reflector 2*d* with respect to the horizontal plane containing the principal optical axis L of the vehicle lamp.

Figure 14B:
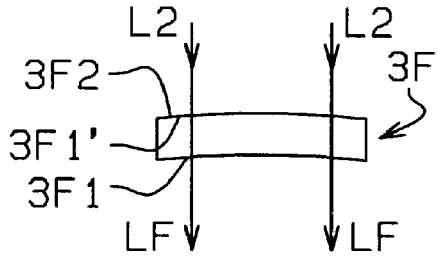
FIGS. 14A, 14B, and 14C are views illustrating in detail a lens cut portion 3F of the lens 3 of the vehicle lamp according to the fifth exemplary embodiment.
Figure 14C:
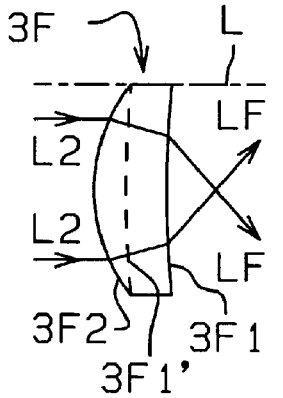
Figure 14A:
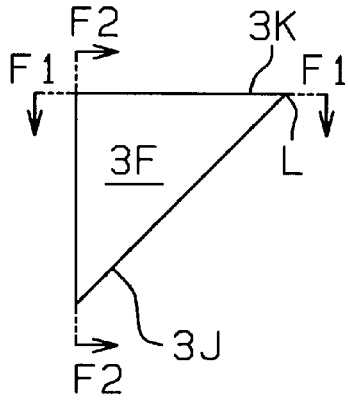

FIGS. 14A to 14C are views illustrating in detail the lens cut portion 3F of the lens 3 according to the vehicle lamp of the fifth exemplary embodiment. More specifically, FIG. 14A is a front view of the lens cut portion 3F of the lens 3 of the vehicle lamp according to the fifth exemplary embodiment, FIG. 14B is a cross-sectional view taken along line F1-F1 of FIG. 14A, and FIG. 14C is a cross-sectional view taken along line F2-F2 of FIG. 14A (a left end face view of the lens cut portion 3F).

The vehicle lamp of the fourth exemplary embodiment as shown in FIGS. 12B and 12C is configured such that the light transmitting surface 3F1 of the lens cut portion 3F is formed to have a flat plane. In contrast to this, as shown in FIGS. 14B and 14C, the vehicle lamp of the fifth exemplary embodiment is configured such that the light transmitting surface 3F1 of the lens cut portion 3F is formed to have a concave surface.

More specifically, as within the cross section (vertical plane) of the vehicle lamp of the fourth exemplary embodiment shown in FIG. 12C, within the cross section (vertical plane) of the vehicle lamp of the fifth exemplary embodiment shown in FIG. 14C, the light incident surface 3F2 of the lens cut portion 3F protrudes rearward of the imaginary plane 3F1' which is defined by offsetting the light transmitting surface 3F1 of the lens cut portion 3F toward the light incident side (leftward in FIG. 14C, toward the reflector 2*a*). Therefore, like the vehicle lamp of the fourth exemplary embodiment, the vehicle lamp of the fifth exemplary embodiment as shown in FIG. 14C is configured such that the generally parallel light beams L2 coming from the parabolic reflective surface of the reflector 2*a* (see FIGS. 3B and 3C) are diffused by the lens cut portion 3F in the up and down directions and projected as the diffused light LF frontward of the vehicle lamp (rightward in FIG. 14C).

Furthermore, as within the cross section (horizontal plane) of the vehicle lamp of the fourth exemplary embodiment shown in FIG. 14B, within the cross section (horizontal plane) of the vehicle lamp of the fifth exemplary embodiment shown in FIG. 14B, the light incident surface 3F2 of the lens cut portion 3F is aligned with the imaginary plane 3F1' which is defined by offsetting the light transmitting surface 3F1 of the lens cut portion 3F toward the light incident side (upward in FIG. 14B, toward the reflector 2*a*). Therefore, like the vehicle lamp of the fourth exemplary embodiment, the vehicle lamp of the fifth exemplary embodiment as shown in FIG. 14B is configured such that the generally parallel light beams L2 coming from the parabolic reflective surface of the reflector 2*a* (see FIGS. 3B and 3C) will not be diffused by the lens cut portion 3F in the left and right directions but projected as light LF traveling across a vertical plane frontward of the vehicle lamp (downward in FIG. 14B).

Furthermore, according to the vehicle lamp of the fifth exemplary embodiment as in the vehicle lamp of the fourth exemplary embodiment shown in FIG. 3A, the lens cut portion 3F illustrated in FIGS. 14A to 14C and the lens cut portion 3H are arranged in a mirror image relationship with respect to the vertical plane containing the principal optical axis L of the vehicle lamp. Furthermore, as shown in FIG. 3B, the light source 1*a* and the parabolic reflective surface of the reflector 2*a* are arranged in a mirror image relationship with the light source 1*b* and the parabolic reflective surface of the reflector 2*b* with respect to the vertical plane containing the principal optical axis L of the vehicle lamp. Furthermore, as shown in FIG. 3A, the lens cut portion 3F illustrated in FIGS. 14A to 14C and the lens cut portion 3E are arranged in a mirror image relationship with respect to the horizontal plane containing the principal optical axis L of the vehicle lamp. Furthermore, as shown in FIG. 3B, the light source 1*a* and the parabolic reflective surface of the reflector 2*a* are arranged in a mirror image relationship with the light source 1*c* and the parabolic reflective surface of the reflector 2*c* with respect to the horizontal plane containing the principal optical axis L of the vehicle lamp. Furthermore, as shown in FIG. 3A, the lens cut portion 3E and the lens cut portion 3G are arranged in a mirror image relationship with respect to the vertical plane containing the principal optical axis L of the vehicle lamp. Furthermore, as shown in FIG. 3B, the light source 1*c* and the parabolic reflective surface of the reflector 2*c* are arranged in a mirror image relationship with the light source 1*d* and the parabolic reflective surface of the reflector 2*d* with respect to the vertical plane containing the principal optical axis L of the vehicle lamp.

A description will now be made with respect to a vehicle lamp according to a sixth exemplary embodiment of the presently disclosed subject matter. The vehicle lamp of the sixth exemplary embodiment is configured generally in the same manner as the vehicle lamp of the third exemplary embodiment described above except for at least the following points. Accordingly, the vehicle lamp of the sixth exemplary embodiment can provide substantially the same effects as those of the vehicle lamp of the third exemplary embodiment described above.

Figure 15A:
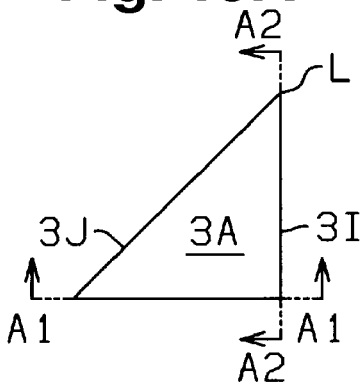
FIGS. 15A, 15B, and 15C are views illustrating in detail a lens cut portion 3A of a lens 3 of a vehicle lamp according to a sixth exemplary embodiment.
Figure 15C:
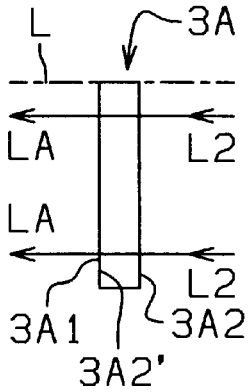
Figure 15B:
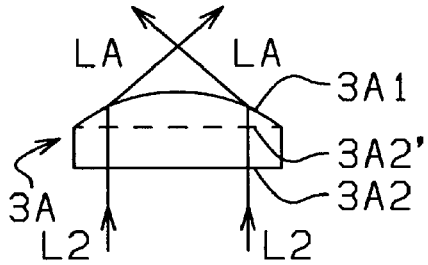

FIGS. 15A to 15C are views illustrating in detail the lens cut portion 3A of the lens 3 according to the vehicle lamp of the sixth exemplary embodiment. More specifically, FIG. 15A is a front view of the lens cut portion 3A of the lens 3 of the vehicle lamp according to the sixth exemplary embodiment, FIG. 15B is a cross-sectional view taken along line A1-A1 of FIG. 15A (a lower end face view of the lens cut portion 3A), and FIG. 15C is a cross-sectional view taken along line A2-A2 of FIG. 15A.

Like the vehicle lamp of the third exemplary embodiment shown in FIG. 9B, the cross section (horizontal plane) of the vehicle lamp of the sixth exemplary embodiment shown in FIG. 15B shows the light transmitting surface 3A1 of the lens cut portion 3A protruding frontward of the imaginary plane 3A2' which is defined by offsetting the light incident surface 3A2 of the lens cut portion 3A toward the light incident side (upward in FIG. 15B, opposite to the reflector 2*a*). Therefore, like the vehicle lamp of the third exemplary embodiment shown in FIG. 9B, the vehicle lamp of the sixth exemplary embodiment as shown in FIG. 15B is configured such that the generally parallel light beams L2 coming from the parabolic reflective surface of the reflector 2*a* (see FIGS. 3B and 8B) are diffused by the lens cut portion 3A in the left and right directions and projected as the diffused light LA frontward of the vehicle lamp (upward in FIG. 15B).

On the other hand, within the cross section (vertical plane) of the vehicle lamp of the third exemplary embodiment shown in FIG. 9D and FIG. 9E, the light transmitting surface 3A1 of the lens cut portion 3A protrudes frontward of the imaginary plane 3A2' which is defined by offsetting the light incident surface 3A2 of the lens cut portion 3A toward the light transmitting side (leftward in FIGS. 9D and 9E, opposite to the reflector 2*a*). In contrast to this, within the cross section (vertical plane) of the vehicle lamp of the sixth exemplary embodiment shown in FIG. 15C, the light transmitting surface 3A1 of the lens cut portion 3A is aligned with the imaginary plane 3A2' which is defined by offsetting the light incident surface 3A2 of the lens cut portion 3A toward the light transmitting side (leftward in FIG. 15C, opposite to the reflector 2*a*). Therefore, in the vehicle lamp of the sixth exemplary embodiment as shown in FIG. 15C, the generally parallel light beams L2 coming from the parabolic reflective surface of the reflector 2*a* (see FIGS. 3B and 3C) will not be diffused by the lens cut portion 3A in the up and down directions but projected frontward of the vehicle lamp (leftward in FIG. 15C) as light LA traveling across a horizontal plane.

Furthermore, like the vehicle lamp of the third exemplary embodiment, the vehicle lamp of the sixth exemplary embodiment as shown in FIG. 15A is configured such that the lens cut portion 3A and the lens cut portion 3C are arranged in a mirror image relationship with respect to the horizontal plane containing the principal optical axis L of the vehicle lamp. Furthermore, as shown in FIG. 3B, the light source 1*a* and the parabolic reflective surface of the reflector 2*a* are arranged in a mirror image relationship with the light source 1*c* and the parabolic reflective surface of the reflector 2*c* with respect to the horizontal plane containing the principal optical axis L of the vehicle lamp. Therefore, like the vehicle lamp of the third exemplary embodiment, the vehicle lamp of the sixth exemplary embodiment is configured such that the generally parallel light beams coming from the parabolic reflective surface of the reflector 2*c* are diffused by the lens cut portion 3C in the left and right directions and projected as diffused light frontward of the vehicle lamp (leftward in FIG. 3B). On the other hand, unlike the vehicle lamp of the third exemplary embodiment, the vehicle lamp of the sixth exemplary embodiment is configured such that the generally parallel light beams coming from the parabolic reflective surface of the reflector 2*c* will not be diffused by the lens cut portion 3C in the up and down directions but projected frontward of the vehicle lamp (leftward in FIG. 3B) as light traveling across a horizontal plane.

Furthermore, according to the vehicle lamp of the sixth exemplary embodiment as in the vehicle lamp of the third exemplary embodiment shown in FIG. 8A, the lens cut portion 3A and the lens cut portion 3B are arranged in a mirror image relationship with respect to the vertical plane containing the principal optical axis L of the vehicle lamp. Furthermore, as shown in FIGS. 3B and 8B, the light source 1*a* and the parabolic reflective surface of the reflector 2*a* are arranged in a mirror image relationship with the light source 1*b* and the parabolic reflective surface of the reflector 2*b* with respect to the vertical plane containing the principal optical axis L of the vehicle lamp. Therefore, like the vehicle lamp of the third exemplary embodiment, the vehicle lamp of the sixth exemplary embodiment is configured such that the generally parallel light beams coming from the parabolic reflective surface of the reflector 2*b* are diffused by the lens cut portion 3B in the left and right directions and projected as diffused light LB frontward of the vehicle lamp (leftward in FIG. 3B, upward in FIG. 8B). On the other hand, unlike the vehicle lamp of the third exemplary embodiment, the vehicle lamp of the sixth exemplary embodiment is configured such that the generally parallel light beams coming from the parabolic reflective surface of the reflector 2*b* will not be diffused by the lens cut portion 3B in the up and down directions but projected frontward of the vehicle lamp (leftward in FIG. 3B, upward in FIG. 8B) as light LB traveling across a horizontal plane.

Furthermore, according to the vehicle lamp of the sixth exemplary embodiment as in the vehicle lamp of the third exemplary embodiment shown in FIG. 8A, the lens cut portion 3B and the lens cut portion 3D are arranged in a mirror image relationship with respect to the horizontal plane containing the principal optical axis L of the vehicle lamp. Furthermore, as shown in FIG. 3B, the light source 1*b* and the parabolic reflective surface of the reflector 2*b* are arranged in a mirror image relationship with the light source 1*d* and the parabolic reflective surface of the reflector 2*d* with respect to the horizontal plane containing the principal optical axis L of the vehicle lamp. Therefore, like the vehicle lamp of the third exemplary embodiment, the vehicle lamp of the sixth exemplary embodiment is configured such that the generally parallel light beams coming from the parabolic reflective surface of the reflector 2*d* are diffused by the lens cut portion 3D in the left and right directions and projected as diffused light frontward of the vehicle lamp (leftward in FIG. 3B). On the other hand, unlike the vehicle lamp of the third exemplary embodiment, the vehicle lamp of the sixth exemplary embodiment is configured such that the generally parallel light beams coming from the parabolic reflective surface of the reflector 2*d* will not be diffused by the lens cut portion 3D in the up and down directions but projected frontward of the vehicle lamp (leftward in FIG. 3B) as light traveling across a horizontal plane.

Figure 16B:
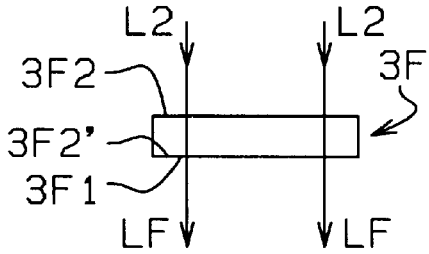
FIGS. 16A, 16B, and 16C are views illustrating in detail a lens cut portion 3F of the lens 3 of the vehicle lamp according to the sixth exemplary embodiment.
Figure 16C:
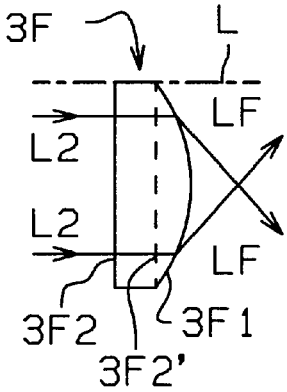
Figure 16A:
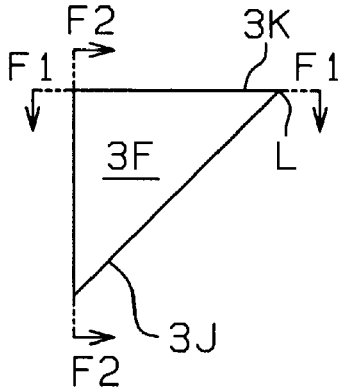

FIGS. 16A to 16C are views illustrating in detail the lens cut portion 3F of the lens 3 according to the vehicle lamp of the sixth exemplary embodiment. More specifically, FIG. 16A is a front view of the lens cut portion 3F of the lens 3 of the vehicle lamp according to the sixth exemplary embodiment, FIG. 16B is a cross-sectional view taken along line F1-F1 of FIG. 16A, and FIG. 16C is a cross-sectional view taken along line F2-F2 of FIG. 16A (a left end face view of the lens cut portion 3F).

More specifically, within the cross section (vertical plane) of the vehicle lamp of the sixth exemplary embodiment as shown in FIG. 16C, the light transmitting surface 3F1 of the lens cut portion 3F protrudes frontward of an imaginary plane 3F2' which is defined by offsetting the light incident surface 3F2 of the lens cut portion 3F toward the light transmitting side (rightward in FIG. 16C, opposite to the reflector 2*a*). Therefore, in the vehicle lamp of the sixth exemplary embodiment as shown in FIG. 16C as in the third exemplary embodiment shown in FIG. 10D, the generally parallel light beams L2 coming from the parabolic reflective surface of the reflector 2*a* (see FIGS. 3B and 3C) are diffused by the lens cut portion 3F in the up and down directions and projected as the diffused light LF frontward of the vehicle lamp (rightward in FIG. 16C).

On the other hand, within the cross section (horizontal plane) of the vehicle lamp of the third exemplary embodiment shown in FIG. 10B and FIG. 10C, the light transmitting surface 3F1 of the lens cut portion 3F protrudes frontward of the imaginary plane 3F2' which is defined by offsetting the light incident surface 3F2 of the lens cut portion 3F toward the light transmitting side (downward in FIGS. 10B and 10C, opposite to the reflector 2*a*). In contrast to this, within the cross section (horizontal plane) of the vehicle lamp of the sixth exemplary embodiment shown in FIG. 16B, the light transmitting surface 3F1 of the lens cut portion 3F is aligned with the imaginary plane 3F2' which is defined by offsetting the light incident surface 3F2 of the lens cut portion 3F toward the light transmitting side (downward in FIG. 16B, opposite to the reflector 2*a*). Therefore, in the vehicle lamp of the sixth exemplary embodiment as shown in FIG. 16B, the generally parallel light beams L2 coming from the parabolic reflective surface of the reflector 2*a* (see FIGS. 3B and 3C) will not be diffused by the lens cut portion 3F in the left and right directions but projected frontward of the vehicle lamp (downward in FIG. 16B) as light LF traveling across a vertical plane.

Furthermore, like the vehicle lamp of the third exemplary embodiment, the vehicle lamp of the sixth exemplary embodiment as shown in FIG. 16A is configured such that the lens cut portion 3F and the lens cut portion 3H are arranged in a mirror image relationship with respect to the vertical plane containing the principal optical axis L of the vehicle lamp. Furthermore, as shown in FIG. 3B and FIG. 8B, the light source 1*a* and the parabolic reflective surface of the reflector 2*a* are arranged in a mirror image relationship with the light source 1*b* and the parabolic reflective surface of the reflector 2*b* with respect to the vertical plane containing the principal optical axis L of the vehicle lamp. Therefore, like the vehicle lamp of the third exemplary embodiment, the vehicle lamp of the sixth exemplary embodiment is configured such that the generally parallel light beams coming from the parabolic reflective surface of the reflector 2*b* are diffused by the lens cut portion 3H in the up and down directions and projected as diffused light frontward of the vehicle lamp (leftward in FIG. 3B). On the other hand, unlike the vehicle lamp of the third exemplary embodiment, the vehicle lamp of the sixth exemplary embodiment is configured such that the generally parallel light beams coming from the parabolic reflective surface of the reflector 2*b* will not be diffused by the lens cut portion 3H in the left and right directions but projected frontward of the vehicle lamp (leftward in FIG. 3B) as light traveling across a vertical plane.

Furthermore, according to the vehicle lamp of the sixth exemplary embodiment as in the vehicle lamp of the third exemplary embodiment shown in FIG. 8A, the lens cut portion 3F and the lens cut portion 3E are arranged in a mirror image relationship with respect to the horizontal plane containing the principal optical axis L of the vehicle lamp. Furthermore, as shown in FIG. 3B, the light source 1*a* and the parabolic reflective surface of the reflector 2*a* are arranged in a mirror image relationship with the light source 1*c* and the parabolic reflective surface of the reflector 2*c* with respect to the horizontal plane containing the principal optical axis L of the vehicle lamp. Therefore, like the vehicle lamp of the third exemplary embodiment, the vehicle lamp of the sixth exemplary embodiment is configured such that the generally parallel light beams coming from the parabolic reflective surface of the reflector 2*c* are diffused by the lens cut portion 3E in the up and down directions and projected as diffused light frontward of the vehicle lamp (leftward in FIG. 3B). On the other hand, unlike the vehicle lamp of the third exemplary embodiment, the vehicle lamp of the sixth exemplary embodiment is configured such that the generally parallel light beams coming from the parabolic reflective surface of the reflector 2*c* will not be diffused by the lens cut portion 3E in the left and right directions but projected frontward of the vehicle lamp (leftward in FIG. 3B) as light traveling across a vertical plane.

Furthermore, according to the vehicle lamp of the sixth exemplary embodiment as in the vehicle lamp of the third exemplary embodiment shown in FIG. 8A, the lens cut portion 3E and the lens cut portion 3G are arranged in a mirror image relationship with respect to the vertical plane containing the principal optical axis L of the vehicle lamp. Furthermore, as shown in FIG. 3B, the light source 1*c* and the parabolic reflective surface of the reflector 2*c* are arranged in a mirror image relationship with the light source 1*d* and the parabolic reflective surface of the reflector 2*d* with respect to the vertical plane containing the principal optical axis L of the vehicle lamp. Therefore, like the vehicle lamp of the third exemplary embodiment, the vehicle lamp of the sixth exemplary embodiment is configured such that the generally parallel light beams coming from the parabolic reflective surface of the reflector 2*d* are diffused by the lens cut portion 3G in the up and down directions and projected as diffused light frontward of the vehicle lamp (leftward in FIG. 3B). On the other hand, unlike the vehicle lamp of the third exemplary embodiment, the vehicle lamp of the sixth exemplary embodiment is configured such that the generally parallel light beams coming from the parabolic reflective surface of the reflector 2*d* will not be diffused by the lens cut portion 3G in the left and right directions but projected frontward of the vehicle lamp (leftward in FIG. 3B) as light traveling across a vertical plane.

A description will now be made with respect to a vehicle lamp according to a seventh exemplary embodiment of the presently disclosed subject matter. The vehicle lamp of the seventh exemplary embodiment is configured generally in the same manner as any of the aforementioned vehicle lamps according to the first to sixth exemplary embodiments except for at least the points to be described below. Accordingly, the vehicle lamp of the seventh exemplary embodiment can provide substantially the same effects as those of any of the aforementioned vehicle lamps according to the first to sixth exemplary embodiments.

Figure 17:
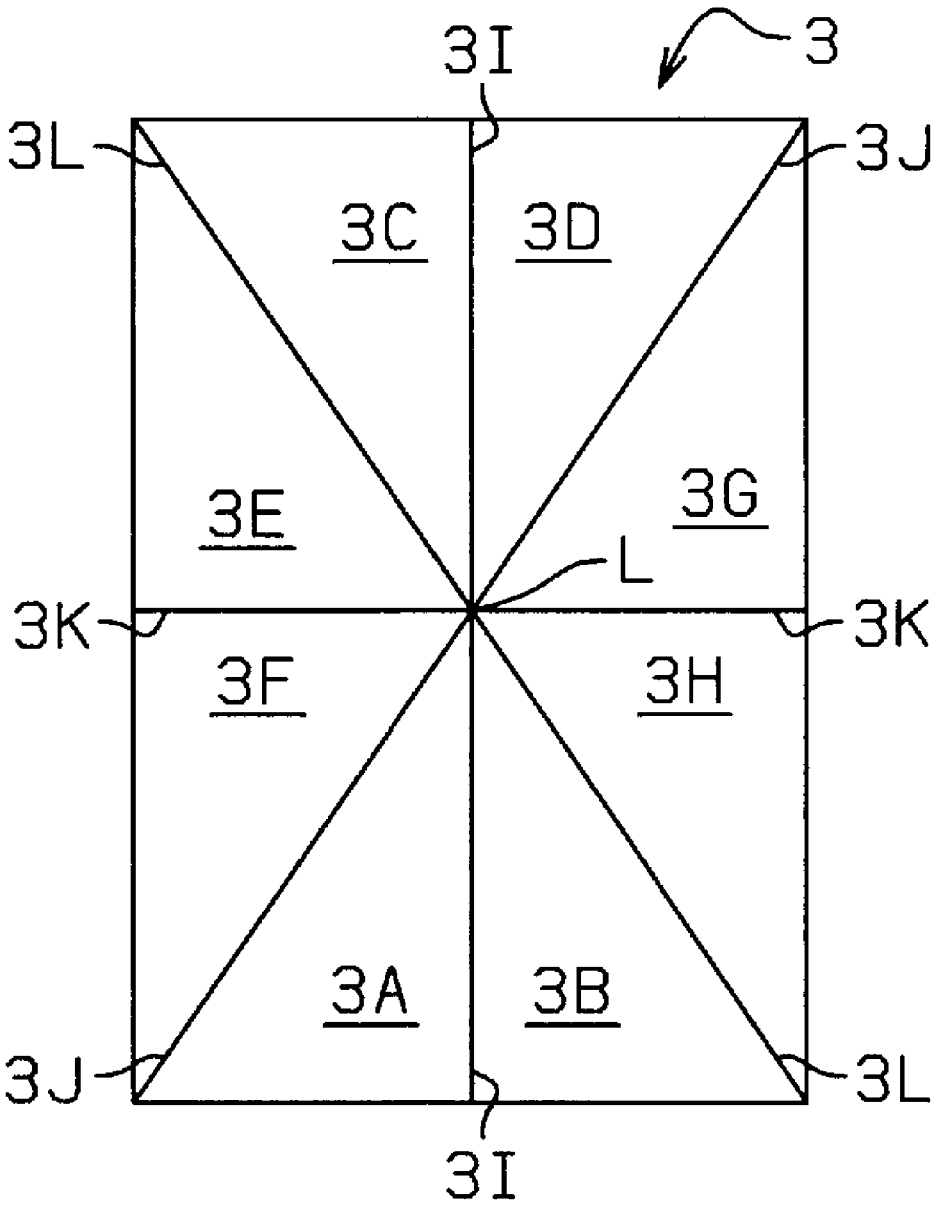
FIG. 17 is a front view illustrating a vehicle lamp of a seventh exemplary embodiment.

FIG. 17 is a front view of the vehicle lamp of the seventh exemplary embodiment. In the vehicle lamps of the first to sixth exemplary embodiments as shown in FIGS. 3A and 8A, the lens 3 is configured to look generally square (or generally rectangular) when viewed from in front of the vehicle lamp. However, in the vehicle lamp of the seventh exemplary embodiment as shown in FIG. 17, the lens 3 is configured to look generally rectangular, longer either in the vertical or horizontal direction, when viewed from in front of the vehicle lamp. Certain of the other features can be the same as or similar to those of the aforementioned exemplary embodiments, and thus will not be repeatedly explained here.

A description will now be made with respect to a vehicle lamp according to an eighth exemplary embodiment of the presently disclosed subject matter. The vehicle lamp of the eighth exemplary embodiment is configured generally in the same manner as the vehicle lamp of the first exemplary embodiment described above except for at least the following points. Accordingly, the vehicle lamp of the eighth exemplary embodiment can provide substantially the same effects as those of the vehicle lamp of the first exemplary embodiment described above.

Figure 18A:
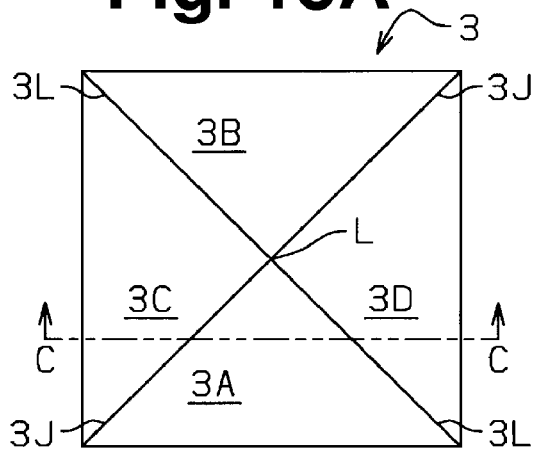
FIGS. 18A, 18B, and 18C are views illustrating a vehicle lamp of an eighth exemplary embodiment.
Figure 18B:
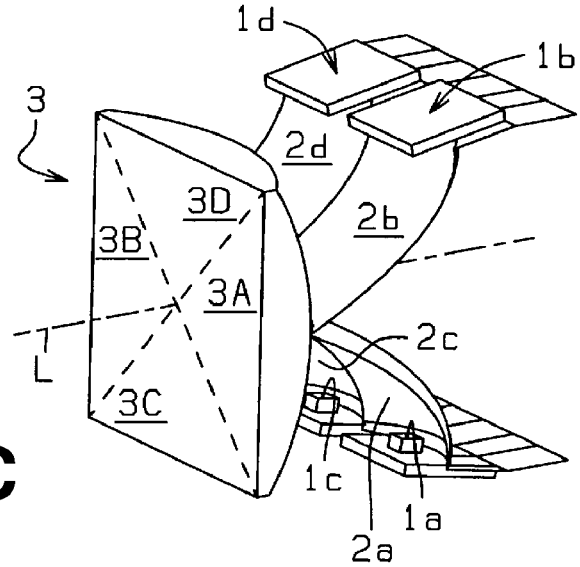
Figure 18C:
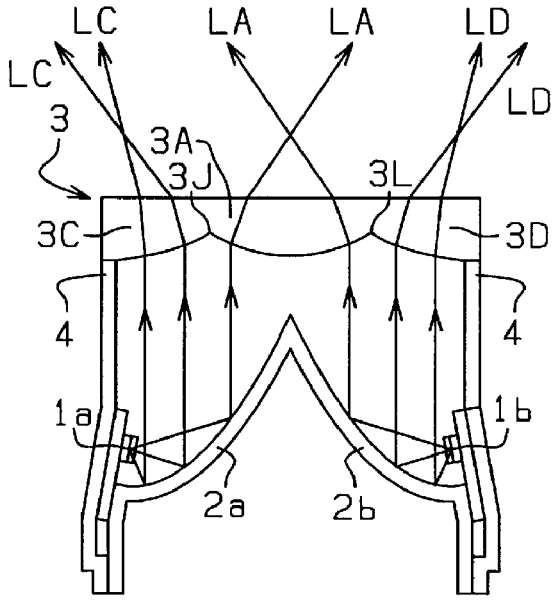

FIGS. 18A to 18C are views illustrating the vehicle lamp of the eighth exemplary embodiment. More specifically, FIG. 18A is a front view illustrating the vehicle lamp of the eighth exemplary embodiment, FIG. 18B being a perspective view thereof, FIG. 18C being a cross-sectional view taken along line C-C of FIG. 18A. It should be noted that FIG. 18B shows the vehicle lamp turned by 90 degrees in order to show the reflectors and LEDs clearly.

As shown in FIG. 3A, FIG. 3B, and FIG. 3C, the vehicle lamp of the first exemplary embodiment is configured such that the generally parallel light beams coming from the parabolic reflective surface of the reflectors 2*a*, 2*b*, 2*c*, and 2*d* are diffused by the lens 3 which has the eight lens cut portions 3A, 3B, 3C, 3D, 3E, 3F, 3G, and 3H. In contrast to this, as shown in FIG. 18A, FIG. 18B, and FIG. 18C, the vehicle lamp of the eighth exemplary embodiment has the lens 3 formed of four lens cut portions 3A, 3B, 3C, and 3D. Therefore, the generally parallel light beams coming from the parabolic reflective surfaces of the reflectors 2*a*, 2*b*, 2*c*, and 2*d* are diffused by the lens 3 which has the lens cut portions 3A, 3B, 3C, and 3D.

More specifically, within the cross section (horizontal plane) shown in FIG. 18C, some part of the generally parallel light beams emitted from the light sources 1*a* and 1*c* and then reflected by the parabolic reflective surfaces of the reflectors 2*a* and 2*c* is diffused by the lens cut portion 3C in the left and right directions and projected as diffused light LC frontward of the vehicle lamp (upward in FIG. 18C). Furthermore, some part of the generally parallel light beams emitted from the light sources 1*a* and 1*b* and then reflected by the parabolic reflective surfaces of the reflectors 2*a* and 2*b* are diffused by the lens cut portion 3A in the left and right directions and projected as the diffused light LA frontward of the vehicle lamp (upward in FIG. 18C). Furthermore, some part of the generally parallel light beams emitted from the light sources 1*b* and 1*d* and then reflected by the parabolic reflective surface of the reflectors 2*b* and 2*d* is diffused by a lens cut portion 3D in the left and right directions and projected as diffused light LD frontward of the vehicle lamp (upward in FIG. 18C).

In the vehicle lamp configured in this manner, the valley lines 3J and 3L extending generally radially from the principal optical axis L divide the generally rectangular lens 3 into the four lens cut portions 3A, 3B, 3C, and 3D.

Figure 19A:
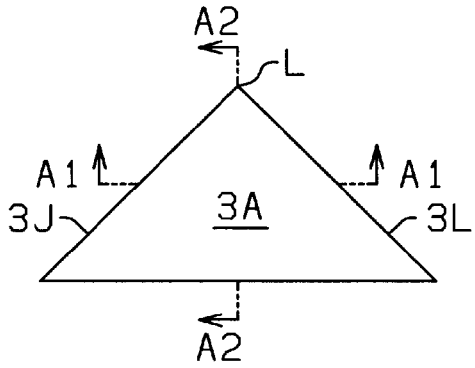
FIGS. 19A, 19B, and 19C are views illustrating in detail a lens cut portion 3A of a lens 3 shown in FIGS. 18A to 18C.
Figure 19C:
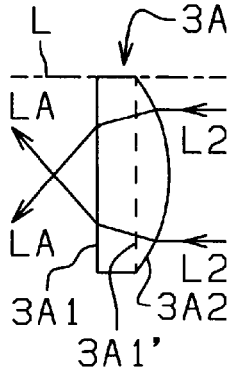
Figure 19B:
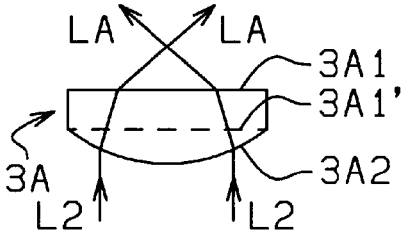

FIGS. 19A to 19C are views illustrating in detail the lens cut portion 3A of the lens 3 shown in FIGS. 18A to 18C. More specifically, FIG. 19A is a front view of the lens cut portion 3A, FIG. 19B is a cross-sectional view taken along line A1-A1 of FIG. 19A, and FIG. 19C is a cross-sectional view taken along line A2-A2 of FIG. 19A.

Within the cross section (horizontal plane) of the vehicle lamp of the eighth exemplary embodiment as shown in FIG. 19B, the light incident surface 3A2 of the lens cut portion 3A protrudes rearward of the imaginary plane 3A1' which is defined by offsetting the light transmitting surface 3A1 of the lens cut portion 3A toward the light incident side (downward in FIG. 19B, toward the reflectors 2*a* and 2*b*). Therefore, in the vehicle lamp of the eighth exemplary embodiment as shown in FIG. 19B, the generally parallel light beams L2 coming from the parabolic reflective surface of the reflectors 2*a* and 2*b* (see FIGS. 18B and 18C) are diffused by the lens cut portion 3A in the left and right directions and projected as the diffused light LA frontward of the vehicle lamp (upward in FIG. 19B).

Furthermore, within the cross section (vertical plane) of the vehicle lamp of the eighth exemplary embodiment as shown in FIG. 19C, the light incident surface 3A2 of the lens cut portion 3A protrudes rearward of the imaginary plane 3A1' which is defined by offsetting the light transmitting surface 3A1 of the lens cut portion 3A toward the light incident side (rightward in FIG. 19C, toward the reflectors 2*a* and 2*b*). Therefore, in the vehicle lamp of the eighth exemplary embodiment as shown in FIG. 19C, the generally parallel light beams L2 coming from the parabolic reflective surface of the reflectors 2*a* and 2*b* (see FIGS. 18B and 18C) are diffused by the lens cut portion 3A in the up and down directions and projected as the diffused light LA frontward of the vehicle lamp (leftward in FIG. 19C).

Furthermore, in the vehicle lamp of the eighth exemplary embodiment as shown in FIG. 18A, the lens cut portion 3A and the lens cut portion 3B are arranged in a mirror image relationship with respect to the horizontal plane containing the principal optical axis L of the vehicle lamp. Furthermore, as shown in FIG. 18B, the light sources 1*a* and 1*b* and the parabolic reflective surfaces of the reflectors 2*a* and 2*b* are arranged in a mirror image relationship with the light sources 1*c* and 1*d* and the parabolic reflective surfaces of the reflectors 2*c* and 2*d* with respect to the horizontal plane containing the principal optical axis L of the vehicle lamp. Therefore, in the vehicle lamp of the eighth exemplary embodiment as shown in FIGS. 18A and 18B, the generally parallel light beams coming from the parabolic reflective surface of the reflectors 2*c* and 2*d* are diffused by the lens cut portion 3B in the left and right directions and projected as diffused light frontward of the vehicle lamp (leftward in FIG. 18B). Furthermore, the generally parallel light beams coming from the parabolic reflective surface of the reflectors 2*c* and 2*d* are diffused by the lens cut portion 3B in the up and down directions and projected as diffused light frontward of the vehicle lamp (leftward in FIG. 18B).

Figure 20B:
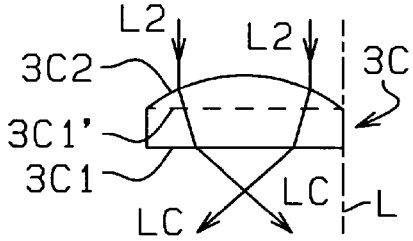
FIGS. 20A, 20B, and 20C are views illustrating in detail a lens cut portion 3C of the lens 3 shown in FIGS. 18A to 18C.
Figure 20A:
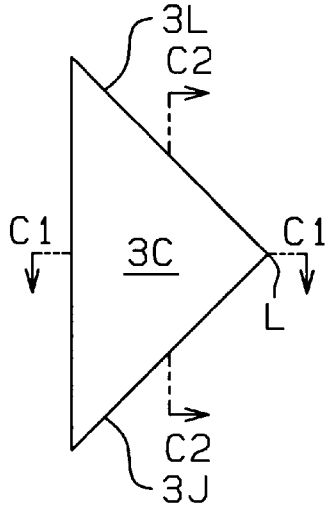
Figure 20C:
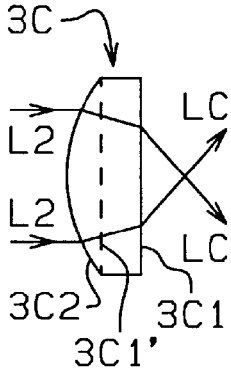

FIGS. 20A to 20C are views illustrating in detail the lens cut portion 3C of the lens 3 shown in FIGS. 18A to 18C. More specifically, FIG. 20A is a front view of the lens cut portion 3C, FIG. 20B is a cross-sectional view taken along line C1-C1 of FIG. 20A, and FIG. 20C is a cross-sectional view taken along line C2-C2 of FIG. 20A.

Within the cross section (horizontal plane) of the vehicle lamp of the eighth exemplary embodiment as shown in FIG. 20B, the light incident surface 3C2 of the lens cut portion 3C protrudes rearward of the imaginary plane 3C1' which is defined by offsetting the light transmitting surface 3C1 of the lens cut portion 3C toward the light incident side (upward in FIG. 20B, toward the reflectors 2*a* and 2*b*). Therefore, in the vehicle lamp of the eighth exemplary embodiment as shown in FIG. 20B, the generally parallel light beams L2 coming from the parabolic reflective surface of the reflectors 2*a* and 2*b* (see FIGS. 18B and 18C) are diffused by the lens cut portion 3C in the left and right directions and projected as the diffused light LC frontward of the vehicle lamp (downward in FIG. 20B).

Furthermore, within the cross section (vertical plane) of the vehicle lamp of the eighth exemplary embodiment as shown in FIG. 20C, the light incident surface 3C2 of the lens cut portion 3C protrudes rearward of the imaginary plane 3C1' which is defined by offsetting the light transmitting surface 3C1 of the lens cut portion 3C toward the light incident side (leftward in FIG. 20C, toward the reflectors 2*a* and 2*b*). Therefore, in the vehicle lamp of the eighth exemplary embodiment as shown in FIG. 20C, the generally parallel light beams L2 coming from the parabolic reflective surface of the reflectors 2*a* and 2*b* (see FIGS. 18B and 18C) are diffused by the lens cut portion 3C in the up and down directions and projected as the diffused light LC frontward of the vehicle lamp (rightward in FIG. 20C).

Furthermore, in the vehicle lamp of the eighth exemplary embodiment as shown in FIG. 18A, the lens cut portion 3C and the lens cut portion 3D are arranged in a mirror image relationship with respect to the vertical plane containing the principal optical axis L of the vehicle lamp. Furthermore, as shown in FIG. 18B, the light sources 1*a* and 1*c* and the parabolic reflective surfaces of the reflectors 2*a* and 2*c* are arranged in a mirror image relationship with the light sources 1*b* and 1*d* and the parabolic reflective surfaces of the reflectors 2*b* and 2*d* with respect to the vertical plane containing the principal optical axis L of the vehicle lamp. Therefore, in the vehicle lamp of the eighth exemplary embodiment as shown in FIGS. 18A, 18B, and 18C, the generally parallel light beams coming from the parabolic reflective surface of the reflectors 2*b* and 2*d* are diffused by the lens cut portion 3D in the left and right directions and projected as diffused light frontward of the vehicle lamp (leftward in FIG. 18B, and upward in FIG. 18C). Furthermore, the generally parallel light beams coming from the parabolic reflective surface of the reflectors 2*b* and 2*d* are diffused by the lens cut portion 3D in the up and down directions and projected as diffused light frontward of the vehicle lamp (leftward in FIG. 18B, and upward in FIG. 18C).

A description will now be made with respect to a vehicle lamp according to a ninth exemplary embodiment of the presently disclosed subject matter. The vehicle lamp of the ninth exemplary embodiment is configured generally in the same manner as the vehicle lamp of the eighth exemplary embodiment described above except for at least the following points. Accordingly, the vehicle lamp of the ninth exemplary embodiment can provide substantially the same effects as those of the vehicle lamp of the eighth exemplary embodiment described above.

Figure 21A:
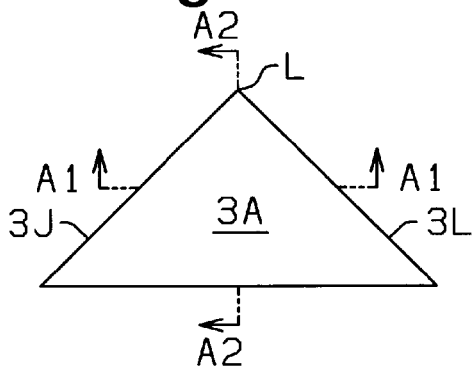
FIGS. 21A, 21B, and 21C are views illustrating in detail a lens cut portion 3A of a lens 3 of a vehicle lamp according to a ninth exemplary embodiment.
Figure 21C:
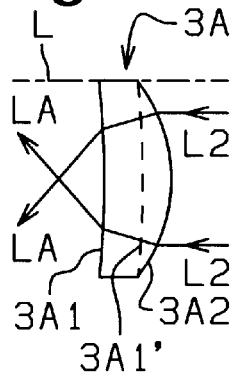
Figure 21B:
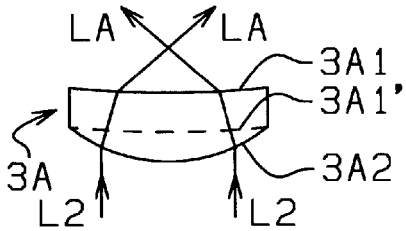

FIGS. 21A to 21C are views illustrating in detail the lens cut portion 3A of the lens 3 of the vehicle lamp of the ninth exemplary embodiment. More specifically, FIG. 21A is a front view of the lens cut portion 3A of the vehicle lamp of the ninth exemplary embodiment, FIG. 20B is a cross-sectional view taken along line A1-A1 of FIG. 21A, and FIG. 21C is a cross-sectional view taken along line A2-A2 of FIG. 21A.

In the vehicle lamp of the eighth exemplary embodiment as shown in FIG. 18B, FIG. 18C, FIG. 19B, and FIG. 19C, the light transmitting surface 3A1 of the lens cut portion 3A is formed on a flat plane. In contrast to this, in the vehicle lamp of the ninth exemplary embodiment as shown in FIGS. 21B and 21C, the light transmitting surface 3A1 of the lens cut portion 3A is formed having a concave surface.

More specifically, within the cross section (horizontal plane) of the vehicle lamp of the ninth exemplary embodiment shown in FIG. 21B, the light incident surface 3A2 of the lens cut portion 3A protrudes rearward of the imaginary plane 3A1' which is defined by offsetting the light transmitting surface 3A1 of the lens cut portion 3A toward the light incident side (downward in FIG. 21B, toward the reflectors 2*a* and 2*b*). Therefore, in the vehicle lamp of the ninth exemplary embodiment as shown in FIG. 21B, the generally parallel light beams L2 coming from the parabolic reflective surfaces of the reflectors 2*a* and 2*b* (see FIGS. 18B and 18C) are diffused by the lens cut portion 3A in the left and right directions and projected as the diffused light LA frontward of the vehicle lamp (upward in FIG. 21B).

Furthermore, within the cross section (vertical plane) of the vehicle lamp of the ninth exemplary embodiment shown in FIG. 21C, the light incident surface 3A2 of the lens cut portion 3A protrudes rearward of the imaginary plane 3A1' which is defined by offsetting the light transmitting surface 3A1 of the lens cut portion 3A toward the light incident side (rightward in FIG. 21C, toward the reflectors 2*a* and 2*b*). Therefore, in the vehicle lamp of the ninth exemplary embodiment as shown in FIG. 21C, the generally parallel light beams L2 coming from the parabolic reflective surfaces of the reflectors 2*a* and 2*b* (see FIGS. 18B and 18C) are diffused by the lens cut portion 3A in the up and down directions and projected as the diffused light LA frontward of the vehicle lamp (leftward in FIG. 21B).

Furthermore, like the vehicle lamp of the eighth exemplary embodiment, the vehicle lamp of the ninth exemplary embodiment as shown in FIG. 18A is configured such that the lens cut portion 3A shown in FIGS. 21A to 21C and the lens cut portion 3B are arranged in a mirror image relationship with respect to the horizontal plane containing the principal optical axis L of the vehicle lamp. Furthermore, as shown in FIG. 18B, the light sources 1*a* and 1*b* and the parabolic reflective surfaces of the reflectors 2*a* and 2*b* are arranged in a mirror image relationship with the light sources 1*c* and 1*d* and the parabolic reflective surfaces of the reflectors 2*c* and 2*d* with respect to the horizontal plane containing the principal optical axis L of the vehicle lamp.

Figure 22B:
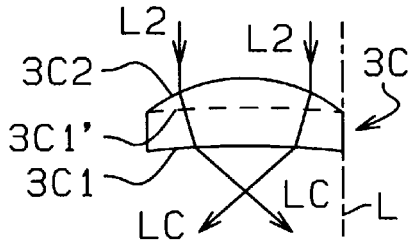
FIGS. 22A, 22B, and 22C are views illustrating in detail a lens cut portion 3C of the lens 3 of the vehicle lamp according to the ninth exemplary embodiment.
Figure 22A:
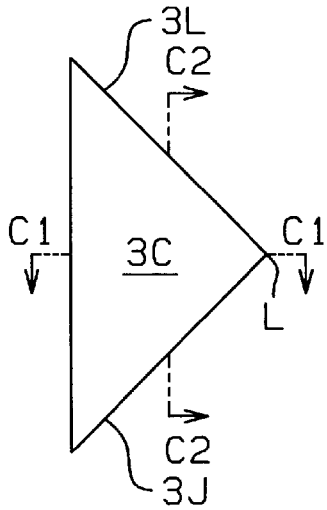
Figure 22C:
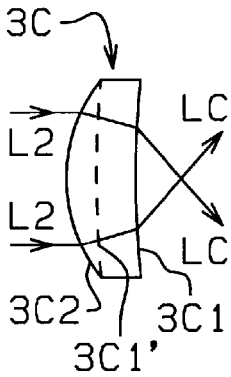

FIGS. 22A to 22C are views illustrating in detail the lens cut portion 3C of the lens 3 of the vehicle lamp of the ninth exemplary embodiment. More specifically, FIG. 22A is a front view of the lens cut portion 3C of the lens 3 of the vehicle lamp of the ninth exemplary embodiment, FIG. 22B is a cross-sectional view taken along line C1-C1 of FIG. 22A, and FIG. 22C is a cross-sectional view taken along line C2-C2 of FIG. 22A.

The vehicle lamp of the eighth exemplary embodiment as shown in FIGS. 18B, 18C, 20B, and 20C is configured such that the light transmitting surface 3C1 of the lens cut portion 3C is formed to have a flat plane. In contrast to this, as shown in FIGS. 22B and 22C, the vehicle lamp of the ninth exemplary embodiment is configured such that the light transmitting surface 3C1 of the lens cut portion 3C is formed to have a concave surface.

More specifically, within the cross section (horizontal plane) of the vehicle lamp of the ninth exemplary embodiment shown in FIG. 22B, the light incident surface 3C2 of the lens cut portion 3C protrudes rearward of the imaginary plane 3C1' which is defined by offsetting the light transmitting surface 3C1 of the lens cut portion 3C toward the light incident side (upward in FIG. 22B, toward the reflectors 2*a* and 2*c*). Therefore, the vehicle lamp of the ninth exemplary embodiment as shown in FIG. 22B is configured such that the generally parallel light beams L2 coming from the parabolic reflective surfaces of the reflectors 2*a* and 2C (see FIGS. 18B and 18C) are diffused by the lens cut portion 3C in the left and right directions and projected as the diffused light LC frontward of the vehicle lamp (downward in FIG. 22B).

Furthermore, within the cross section (vertical plane) of the vehicle lamp of the ninth exemplary embodiment shown in FIG. 22C, the light incident surface 3C2 of the lens cut portion 3C protrudes rearward of the imaginary plane 3C1' which is defined by offsetting the light transmitting surface 3C1 of the lens cut portion 3C toward the light incident side (leftward in FIG. 22C, toward the reflectors 2*a* and 2*c*). Therefore, the vehicle lamp of the ninth exemplary embodiment as shown in FIG. 22C is configured such that the generally parallel light beams L2 coming from the parabolic reflective surfaces of the reflectors 2*a* and 2C (see FIGS. 18B and 18C) are diffused by the lens cut portion 3C in the up and down directions and projected as the diffused light LC frontward of the vehicle lamp (rightward in FIG. 22C).

Furthermore, according to the vehicle lamp of the ninth exemplary embodiment as in the vehicle lamp of the eighth exemplary embodiment shown in FIG. 18A, the lens cut portion 3C illustrated in FIGS. 22A to 22C and the lens cut portion 3D are arranged in a mirror image relationship with respect to the vertical plane containing the principal optical axis L of the vehicle lamp. Furthermore, as shown in FIG. 18B, the light sources 1*a* and 1*c* and the parabolic reflective surfaces of the reflectors 2*a* and 2*c* are arranged in a mirror image relationship with the light sources 1*b* and 1*d* and the parabolic reflective surfaces of the reflectors 2*b* and 2*d* with respect to the vertical plane containing the principal optical axis L of the vehicle lamp.

A description will now be made with respect to a vehicle lamp according to a tenth exemplary embodiment of the presently disclosed subject matter. The vehicle lamp of the tenth exemplary embodiment is configured generally in the same manner as the vehicle lamp of the eighth exemplary embodiment described above except for at least the following points. Accordingly, the vehicle lamp of the tenth exemplary embodiment can provide substantially the same effects as those of the vehicle lamp of the eighth exemplary embodiment described above.

Figure 23A:
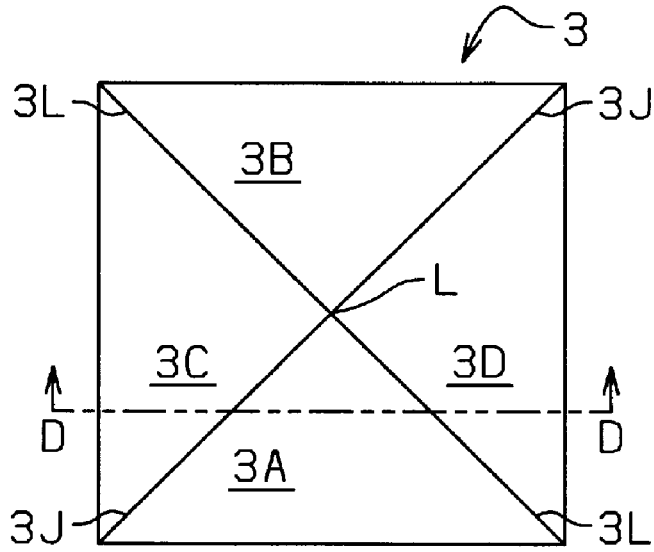
FIGS. 23A, and 23B are views illustrating a vehicle lamp of a tenth exemplary embodiment.
Figure 23B:
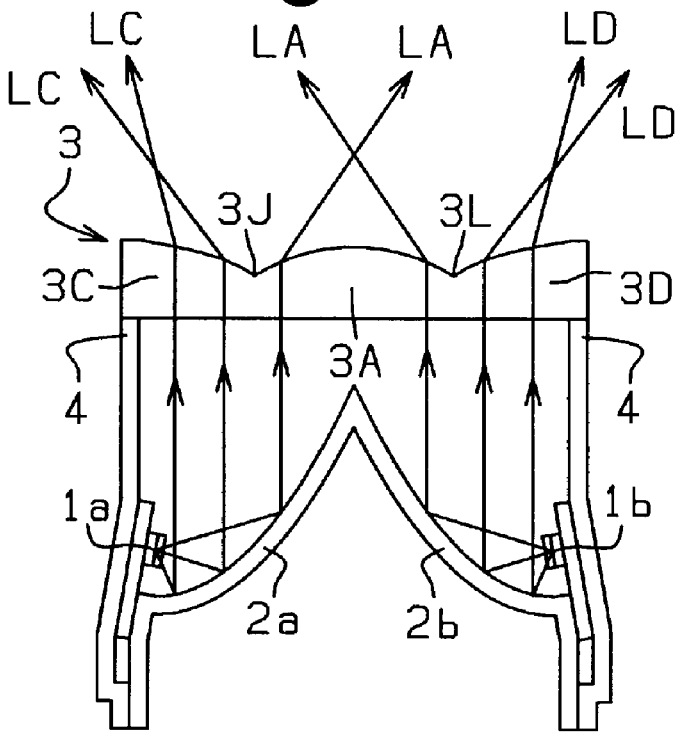

FIGS. 23A and 23B are views illustrating the vehicle lamp of the tenth exemplary embodiment. More specifically, FIG. 23A is a front view illustrating the vehicle lamp of the tenth exemplary embodiment, FIG. 23B being a cross-sectional view taken along line D-D of FIG. 23A.

Figure 24A:
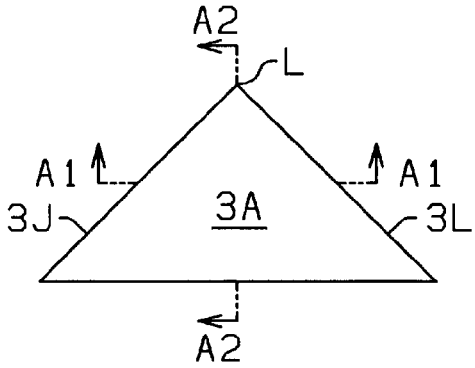
FIGS. 24A, 24B, and 24C are views illustrating in detail a lens cut portion 3A of a lens 3 of the vehicle lamp according to the tenth exemplary embodiment.
Figure 24C:
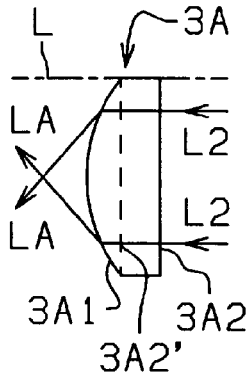
Figure 24B:
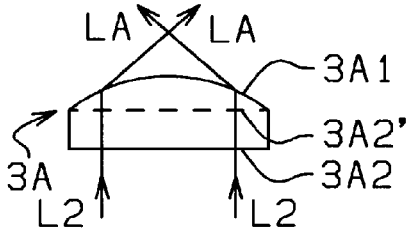

FIGS. 24A to 24C are views illustrating in detail the lens cut portion 3A of the lens 3 of the vehicle lamp of the tenth exemplary embodiment. More specifically, FIG. 24A is a front view of the lens cut portion 3A of the vehicle lamp of the tenth exemplary embodiment, FIG. 24B is a cross-sectional view taken along line A1-A1 of FIG. 24A, and FIG. 24C is a cross-sectional view taken along line A2-A2 of FIG. 24A.

In the vehicle lamp of the eighth exemplary embodiment as shown in FIG. 18B, FIG. 18C, FIG. 19B, and FIG. 19C, the light transmitting surface 3A1 of the lens cut portion 3A is formed as a flat plane, and the light incident surface 3A2 of the lens cut portion 3A is formed having a convex surface. In contrast to this, in the vehicle lamp of the tenth exemplary embodiment as shown in FIG. 23B, FIG. 24B, and FIG. 24C, the light transmitting surface 3A1 of the lens cut portion 3A is formed as having a convex surface, and the light incident surface 3A2 of the lens cut portion 3A is formed having a flat plane or concave surface.

More specifically, within the cross section (horizontal plane) of the vehicle lamp of the tenth exemplary embodiment shown in FIG. 24B, the light transmitting surface 3A1 of the lens cut portion 3A protrudes frontward of the imaginary plane 3A2' which is defined by offsetting the light incident surface 3A2 of the lens cut portion 3A toward the light transmitting side (upward in FIG. 24B, opposite to the reflectors 2*a* and 2*b*). Therefore, in the vehicle lamp of the tenth exemplary embodiment as shown in FIG. 24B, the generally parallel light beams L2 coming from the parabolic reflective surfaces of the reflectors 2*a* and 2*b* (see FIGS. 23B and 18B) are diffused by the lens cut portion 3A in the left and right directions and projected as the diffused light LA frontward of the vehicle lamp (upward in FIG. 24B).

Furthermore, within the cross section (vertical plane) of the vehicle lamp of the tenth exemplary embodiment shown in FIG. 24C, the light transmitting surface 3A1 of the lens cut portion 3A protrudes frontward of the imaginary plane 3A2' which is defined by offsetting the light incident surface 3A2 of the lens cut portion 3A toward the light transmitting side (leftward in FIG. 24C, opposite to the reflectors 2*a* and 2*b*). Therefore, in the vehicle lamp of the tenth exemplary embodiment as shown in FIG. 24C, the generally parallel light beams L2 coming from the parabolic reflective surfaces of the reflectors 2*a* and 2*b* (see FIGS. 23B and 18B) are diffused by the lens cut portion 3A in the up and down directions and projected as the diffused light LA frontward of the vehicle lamp (leftward in FIG. 24C).

Furthermore, like the vehicle lamp of the eighth exemplary embodiment, the vehicle lamp of the tenth exemplary embodiment as shown in FIG. 23A is configured such that the lens cut portion 3A shown in FIGS. 24A to 24C and the lens cut portion 3B are arranged in a mirror image relationship with respect to the horizontal plane containing the principal optical axis L of the vehicle lamp. Furthermore, as shown in FIG. 18B, the light sources 1*a* and 1*b* and the parabolic reflective surfaces of the reflectors 2*a* and 2*b* are arranged in a mirror image relationship with the light sources 1*c* and 1*d* and the parabolic reflective surfaces of the reflectors 2*c* and 2*d* with respect to the horizontal plane containing the principal optical axis L of the vehicle lamp.

Figure 25B:
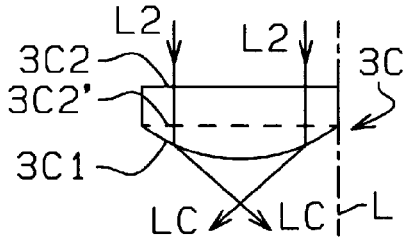
FIGS. 25A, 25B, and 25C are views illustrating in detail a lens cut portion 3C of the lens 3 of the vehicle lamp according to the tenth exemplary embodiment.
Figure 25A:
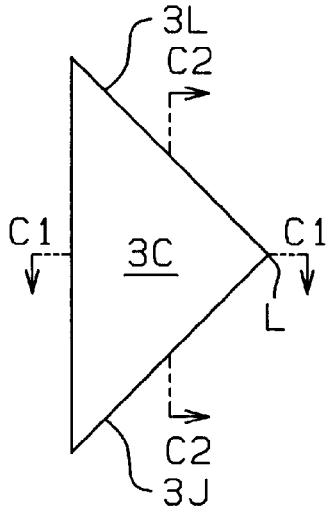
Figure 25C:
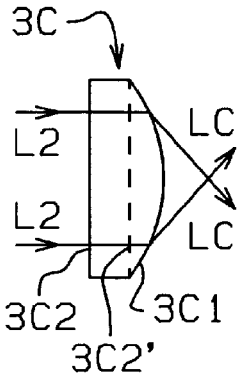

FIGS. 25A to 25C are views illustrating in detail the lens cut portion 3C of the lens 3 of the vehicle lamp of the tenth exemplary embodiment. More specifically, FIG. 25A is a front view of the lens cut portion 3C of the lens 3 of the vehicle lamp of the tenth exemplary embodiment, FIG. 25B is a cross-sectional view taken along line C1-C1 of FIG. 25A, and FIG. 25C is a cross-sectional view taken along line C2-C2 of FIG. 25A.

The vehicle lamp of the eighth exemplary embodiment as shown in FIGS. 18B, 18C, 20B, and 20C can be configured such that the light transmitting surface 3C1 of the lens cut portion 3C includes a flat plane, and the light incident surface 3C2 of the lens cut portion 3C includes a convex surface. In contrast to this, as shown in FIGS. 23B, 25B, and 25C, the vehicle lamp of the tenth exemplary embodiment is configured such that the light transmitting surface 3C1 of the lens cut portion 3C includes a convex surface, and the light incident surface 3C2 of the lens cut portion 3C is formed to have a flat plane or a concave surface.

More specifically, within the cross section (horizontal plane) of the vehicle lamp of the tenth exemplary embodiment shown in FIG. 25B, the light transmitting surface 3C1 of the lens cut portion 3C protrudes frontward of the imaginary plane 3C2' which is defined by offsetting the light incident surface 3C2 of the lens cut portion 3C toward the light transmitting side (downward in FIG. 25B, opposite to the reflectors 2*a* and 2*c*). Therefore, the vehicle lamp of the tenth exemplary embodiment as shown in FIG. 25B is configured such that the generally parallel light beams L2 coming from the parabolic reflective surfaces of the reflectors 2*a* and 2C (see FIGS. 23B and 18B) are diffused by the lens cut portion 3C in the left and right directions and projected as the diffused light LC frontward of the vehicle lamp (downward in FIG. 25B).

Furthermore, within the cross section (vertical plane) of the vehicle lamp of the tenth exemplary embodiment shown in FIG. 25C, the light transmitting surface 3C1 of the lens cut portion 3C protrudes frontward of the imaginary plane 3C2' which is defined by offsetting the light incident surface 3C2 of the lens cut portion 3C toward the light transmitting side (rightward in FIG. 25C, opposite to the reflectors 2*a* and 2*c*). Therefore, the vehicle lamp of the tenth exemplary embodiment as shown in FIG. 25C is configured such that the generally parallel light beams L2 coming from the parabolic reflective surfaces of the reflectors 2*a* and 2C (see FIGS. 23B and 18B) are diffused by the lens cut portion 3C in the up and down directions and projected as the diffused light LC frontward of the vehicle lamp (rightward in FIG. 25C).

Furthermore, according to the vehicle lamp of the tenth exemplary embodiment as in the vehicle lamp of the ninth exemplary embodiment shown in FIG. 23A, the lens cut portion 3C illustrated in FIGS. 25A to 25C and the lens cut portion 3D are arranged in a mirror image relationship with respect to the vertical plane containing the principal optical axis L of the vehicle lamp. Furthermore, as shown in FIG. 18B, the light sources 1*a* and 1*c* and the parabolic reflective surfaces of the reflectors 2*a* and 2*c* are arranged in a mirror image relationship with the light sources 1*b* and 1*d* and the parabolic reflective surfaces of the reflectors 2*b* and 2*d* with respect to the vertical plane containing the principal optical axis L of the vehicle lamp.

A description will now be made with respect to a vehicle lamp according to an eleventh exemplary embodiment of the presently disclosed subject matter. The vehicle lamp of the eleventh exemplary embodiment is configured generally in the same manner as the vehicle lamp of the eighth exemplary embodiment described above except for at least the following points. Accordingly, the vehicle lamp of the eleventh exemplary embodiment can provide substantially the same effects as those of the vehicle lamp of the eighth exemplary embodiment described above.

Figure 26A:
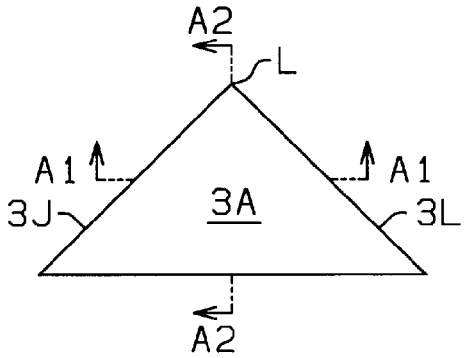
FIGS. 26A, 26B, and 26C are views illustrating in detail a lens cut portion 3A of a lens 3 of a vehicle lamp according to an eleventh exemplary embodiment.
Figure 26C:
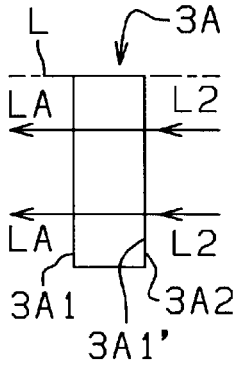
Figure 26B:
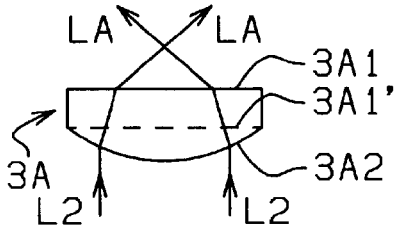

FIGS. 26A to 26C are views illustrating in detail the lens cut portion 3A of the lens 3 of the vehicle lamp of the eleventh exemplary embodiment. More specifically, FIG. 26A is a front view of the lens cut portion 3A of the lens 3 of the vehicle lamp of the eleventh exemplary embodiment, FIG. 26B is a cross-sectional view taken along line A1-A1 of FIG. 26A, and FIG. 26C is a cross-sectional view taken along line A2-A2 of FIG. 26A.

More specifically, as in the vehicle lamp of the eighth exemplary embodiment shown in FIG. 19B, within the cross section (horizontal plane) of the vehicle lamp of the eleventh exemplary embodiment shown in FIG. 26B, the light incident surface 3A2 of the lens cut portion 3A protrudes rearward of the imaginary plane 3A1' which is defined by offsetting the light transmitting surface 3A1 of the lens cut portion 3A toward the light incident side (downward in FIG. 26B, toward the reflector 2*a*). Therefore, as in the vehicle lamp of the eighth exemplary embodiment shown in FIG. 19B, in the vehicle lamp of the eleventh exemplary embodiment as shown in FIG. 26B, the generally parallel light beams L2 coming from the parabolic reflective surfaces of the reflectors 2*a* and 2*b* (see FIGS. 18B and 18C) are diffused by the lens cut portion 3A in the left and right directions and projected as the diffused light LA frontward of the vehicle lamp (upward in FIG. 26B).

On the other hand, within the cross section (vertical plane) of the vehicle lamp of the eighth exemplary embodiment as shown in FIG. 19C, the light incident surface 3A2 of the lens cut portion 3A protrudes rearward of the imaginary plane 3A1' which is defined by offsetting the light transmitting surface 3A1 of the lens cut portion 3A toward the light incident side (rightward in FIG. 19C, toward the reflectors 2*a* and 2*b*). In contrast to this, within the cross section (vertical plane) of the vehicle lamp of the eleventh exemplary embodiment shown in FIG. 26C, the light incident surface 3A2 of the lens cut portion 3A is aligned with the imaginary plane 3A1' which is defined by offsetting the light transmitting surface 3A1 of the lens cut portion 3A toward the light incident side (rightward in FIG. 26C, toward the reflectors 2*a* and 2*b*). Therefore, in the vehicle lamp of the eleventh exemplary embodiment as shown in FIG. 26C, the generally parallel light beams L2 coming from the parabolic reflective surfaces of the reflectors 2*a* and 2*b* (see FIGS. 18B and 18C) will not be diffused by the lens cut portion 3A in the up and down directions but projected as light LA traveling across a horizontal plane frontward of the vehicle lamp (leftward in FIG. 26C).

Furthermore, like the vehicle lamp of the eighth exemplary embodiment, the vehicle lamp of the eleventh exemplary embodiment can be configured such that the lens cut portion 3A and the lens cut portion 3B are arranged in a mirror image relationship with respect to the horizontal plane containing the principal optical axis L of the vehicle lamp. Furthermore, as shown in FIG. 18B, the light sources 1*a* and 1*b* and the parabolic reflective surfaces of the reflectors 2*a* and 2*b* are arranged in a mirror image relationship with the light sources 1*c* and 1*d* and the parabolic reflective surfaces of the reflectors 2*c* and 2*d* with respect to the horizontal plane containing the principal optical axis L of the vehicle lamp. Therefore, like the vehicle lamp of the eighth exemplary embodiment, the vehicle lamp of the eleventh exemplary embodiment is configured such that the generally parallel light beams coming from the parabolic reflective surfaces of the reflectors 2*c* and 2*d* are diffused by the lens cut portion 3B in the left and right directions and projected as the diffused light frontward of the vehicle lamp (leftward in FIG. 18B). On the other hand, unlike the vehicle lamp of the eighth exemplary embodiment, the vehicle lamp of the eleventh exemplary embodiment is configured such that the generally parallel light beams coming from the parabolic reflective surfaces of the reflectors 2*c* and 2*d* will not be diffused by the lens cut portion 3B in the up and down directions but projected frontward of the vehicle lamp (leftward in FIG. 18B) as light traveling across a horizontal plane.

Figure 27B:
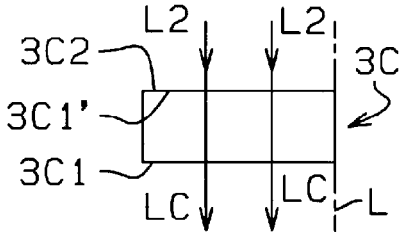
FIGS. 27A, 27B, and 27C are views illustrating in detail a lens cut portion 3C of the lens 3 of the vehicle lamp according to the eleventh exemplary embodiment.
Figure 27C:
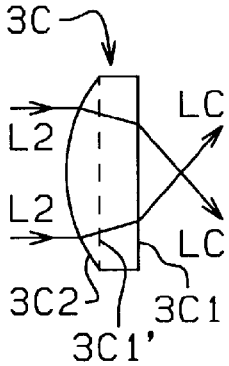
Figure 27A:
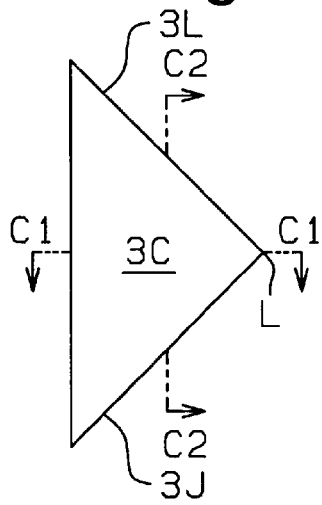

FIGS. 27A to 27C are views illustrating in detail the lens cut portion 3C of the lens 3 of the vehicle lamp of the eleventh exemplary embodiment. More specifically, FIG. 27A is a front view of the lens cut portion 3C of the lens 3 of the vehicle lamp of the eleventh exemplary embodiment, FIG. 27B is a cross-sectional view taken along line C1-C1 of FIG. 27A, and FIG. 27C is a cross-sectional view taken along line C2-C2 of FIG. 27A.

More specifically, as in the vehicle lamp of the eighth exemplary embodiment shown in FIG. 20C, within the cross section (vertical plane) of the vehicle lamp of the eleventh exemplary embodiment shown in FIG. 27C, the light incident surface 3C2 of the lens cut portion 3C protrudes rearward of the imaginary plane 3C1' which is defined by offsetting the light transmitting surface 3C1 of the lens cut portion 3C toward the light incident side (leftward in FIG. 27C, toward the reflectors 2*a* and 2*c*). Therefore, as in the vehicle lamp of the eighth exemplary embodiment shown in FIG. 20C, in the vehicle lamp of the eleventh exemplary embodiment as shown in FIG. 26C, the generally parallel light beams L2 coming from the parabolic reflective surfaces of the reflectors 2*a* and 2*c* (see FIGS. 18B and 18C) are diffused by the lens cut portion 3C in the up and down directions and projected as the diffused light LC frontward of the vehicle lamp (rightward in FIG. 27C).

On the other hand, within the cross section (horizontal plane) of the vehicle lamp of the eighth exemplary embodiment as shown in FIG. 20B, the light incident surface 3C2 of the lens cut portion 3C protrudes rearward of the imaginary plane 3C1' which is defined by offsetting the light transmitting surface 3C1 of the lens cut portion 3C toward the light incident side (upward in FIG. 20B, toward the reflectors 2*a* and 2*b*). In contrast to this, within the cross section (horizontal plane) of the vehicle lamp of the eleventh exemplary embodiment shown in FIG. 27B, the light incident surface 3C2 of the lens cut portion 3C is aligned with the imaginary plane 3C1' which is defined by offsetting the light transmitting surface 3C1 of the lens cut portion 3C toward the light incident side (upward in FIG. 27B, toward the reflectors 2*a* and 2*b*). Therefore, in the vehicle lamp of the eleventh exemplary embodiment as shown in FIG. 27B, the generally parallel light beams L2 coming from the parabolic reflective surfaces of the reflectors 2*a* and 2*c* (see FIGS. 18B and 18C) will not be diffused by the lens cut portion 3C in the left and right directions but projected as light LC traveling across a vertical plane frontward of the vehicle lamp (downward in FIG. 27B).

Furthermore, like the vehicle lamp of the eighth exemplary embodiment, the vehicle lamp of the eleventh exemplary embodiment can be configured such that the lens cut portion 3C and the lens cut portion 3D are arranged in a mirror image relationship with respect to the vertical plane containing the principal optical axis L of the vehicle lamp. Furthermore, as shown in FIG. 18B, the light sources 1*a* and 1*c* and the parabolic reflective surfaces of the reflectors 2*a* and 2*c* are arranged in a mirror image relationship with the light sources 1*b* and 1*d* and the parabolic reflective surfaces of the reflectors 2*b* and 2*d* with respect to the vertical plane containing the principal optical axis L of the vehicle lamp. Therefore, like the vehicle lamp of the eighth exemplary embodiment, the vehicle lamp of the eleventh exemplary embodiment is configured such that the generally parallel light beams coming from the parabolic reflective surfaces of the reflectors 2*b* and 2*d* are diffused by the lens cut portion 3D in the up and down directions and projected as the diffused light frontward of the vehicle lamp (leftward in FIG. 18B). On the other hand, unlike the vehicle lamp of the eighth exemplary embodiment, the vehicle lamp of the eleventh exemplary embodiment is configured such that the generally parallel light beams coming from the parabolic reflective surfaces of the reflectors 2*b* and 2*d* will not be diffused by the lens cut portion 3D in the left and right directions but projected frontward of the vehicle lamp (leftward in FIG. 18B) as light traveling across a vertical plane.

A description will now be made with respect to a vehicle lamp according to a twelfth exemplary embodiment of the presently disclosed subject matter. The vehicle lamp of the twelfth exemplary embodiment is configured generally in the same manner as the vehicle lamp of the eleventh exemplary embodiment described above except for at least the following points. Accordingly, the vehicle lamp of the twelfth exemplary embodiment can provide substantially the same effects as those of the vehicle lamp of the eleventh exemplary embodiment described above.

Figure 28A:
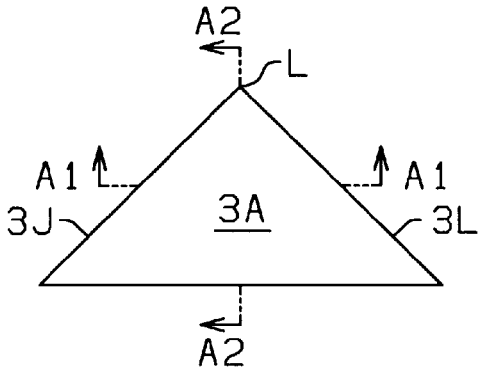
FIGS. 28A, 28B, and 28C are views illustrating in detail a lens cut portion 3A of a lens 3 of a vehicle lamp according to a twelfth exemplary embodiment.
Figure 28C:
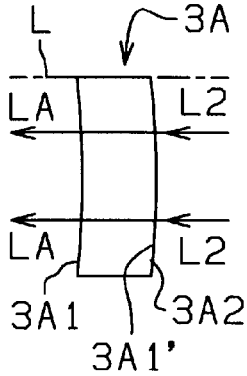
Figure 28B:
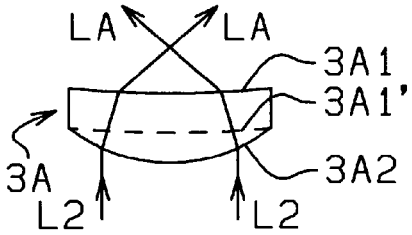

FIGS. 28A to 28C are views illustrating in detail the lens cut portion 3A of the lens 3 of the vehicle lamp of the twelfth exemplary embodiment. More specifically, FIG. 28A is a front view of the lens cut portion 3A of the lens 3 of the vehicle lamp of the twelfth exemplary embodiment, FIG. 28B is a cross-sectional view taken along line A1-A1 of FIG. 28A, and FIG. 28C is a cross-sectional view taken along line A2-A2 of FIG. 28A.

In the vehicle lamp of the eleventh exemplary embodiment as shown in FIGS. 26B and 26C, the light transmitting surface 3A1 of the lens cut portion 3A is formed as a flat plane. However, in the vehicle lamp of the twelfth exemplary embodiment, as shown in FIGS. 28B and 28C, the light transmitting surface 3A1 of the lens cut portion 3A is formed to include a concave surface.

More specifically, as in the vehicle lamp of the eleventh exemplary embodiment shown in FIG. 26B, within the cross section (horizontal plane) of the vehicle lamp of the twelfth exemplary embodiment shown in FIG. 28B, the light incident surface 3A2 of the lens cut portion 3A protrudes rearward of the imaginary plane 3A1' which is defined by offsetting the light transmitting surface 3A1 of the lens cut portion 3A toward the light incident side (downward in FIG. 28B, toward the reflectors 2*a* and 2*b*). Therefore, as in the vehicle lamp of the eleventh exemplary embodiment, in the vehicle lamp of the twelfth exemplary embodiment as shown in FIG. 28B, the generally parallel light beams L2 coming from the parabolic reflective surfaces of the reflectors 2*a* and 2*b* (see FIGS. 18B and 18C) are diffused by the lens cut portion 3A in the left and right directions and projected as the diffused light LA frontward of the vehicle lamp (upward in FIG. 28B).

Furthermore, as within the cross section (vertical plane) of the vehicle lamp of the eleventh exemplary embodiment shown in FIG. 26C, within the cross section (vertical plane) of the vehicle lamp of the twelfth exemplary embodiment shown in FIG. 28C, the light incident surface 3A2 of the lens cut portion 3A is aligned with the imaginary plane 3A1' which is defined by offsetting the light transmitting surface 3A1 of the lens cut portion 3A toward the light incident side (rightward in FIG. 28C, toward the reflectors 2*a* and 2*b*). Therefore, as in the vehicle lamp of the eleventh exemplary embodiment, in the vehicle lamp of the twelfth exemplary embodiment as shown in FIG. 28C, the generally parallel light beams L2 coming from the parabolic reflective surfaces of the reflectors 2*a* and 2*b* (see FIGS. 18B and 18C) will not be diffused by the lens cut portion 3A in the up and down directions but projected as light LA traveling across a horizontal plane frontward of the vehicle lamp (leftward in FIG. 28C).

Furthermore, like the vehicle lamp of the eleventh exemplary embodiment, the vehicle lamp of the twelfth exemplary embodiment can be configured such that the lens cut portion 3A shown in FIGS. 28A to 28C and the lens cut portion 3B are arranged in a mirror image relationship with respect to the horizontal plane containing the principal optical axis L of the vehicle lamp. Furthermore, as shown in FIG. 18B, the light sources 1*a* and 1*b* and the parabolic reflective surfaces of the reflectors 2*a* and 2*b* are arranged in a mirror image relationship with the light sources 1*c* and 1*d* and the parabolic reflective surfaces of the reflectors 2*c* and 2*d* with respect to the horizontal plane containing the principal optical axis L of the vehicle lamp.

Figure 29B:
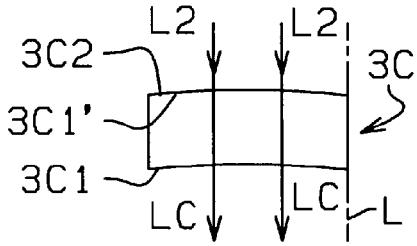
FIGS. 29A, 29B, and 29C are views illustrating in detail a lens cut portion 3C of the lens 3 of the vehicle lamp according to the twelfth exemplary embodiment.
Figure 29C:
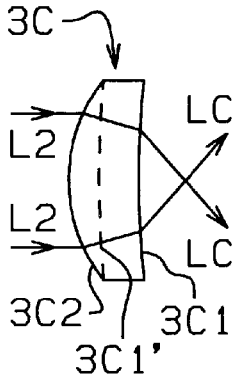
Figure 29A:
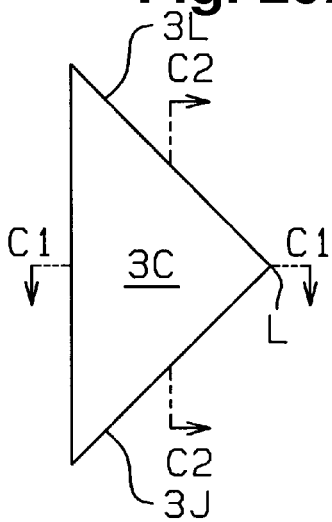

FIGS. 29A to 29C are views illustrating in detail the lens cut portion 3C of the lens 3 of the vehicle lamp of the twelfth exemplary embodiment. More specifically, FIG. 29A is a front view of the lens cut portion 3C of the lens 3 of the vehicle lamp of the twelfth exemplary embodiment, FIG. 29B is a cross-sectional view taken along line C1-C1 of FIG. 29A, and FIG. 29C is a cross-sectional view taken along line C2-C2 of FIG. 29A.

In the vehicle lamp of the eleventh exemplary embodiment as shown in FIGS. 27B and 27C, the light transmitting surface 3C1 of the lens cut portion 3C is formed as a flat plane. However, in the vehicle lamp of the twelfth exemplary embodiment, as shown in FIGS. 29B and 29C, the light transmitting surface 3C1 of the lens cut portion 3C is formed to have a concave surface.

More specifically, as within the cross section (vertical plane) of the vehicle lamp of the eleventh exemplary embodiment shown in FIG. 27C, within the cross section (vertical plane) of the vehicle lamp of the twelfth exemplary embodiment shown in FIG. 29C, the light incident surface 3C2 of the lens cut portion 3C protrudes rearward of the imaginary plane 3C1' which is defined by offsetting the light transmitting surface 3C1 of the lens cut portion 3C toward the light incident side (leftward in FIG. 29C, toward the reflectors 2*a* and 2*c*). Therefore, as in the vehicle lamp of the eleventh exemplary embodiment, in the vehicle lamp of the twelfth exemplary embodiment as shown in FIG. 29C, the generally parallel light beams L2 coming from the parabolic reflective surfaces of the reflectors 2*a* and 2*c* (see FIGS. 18B and 18C) are diffused by the lens cut portion 3C in the up and down directions and projected as the diffused light LC frontward of the vehicle lamp (rightward in FIG. 29C).

Furthermore, as within the cross section (horizontal plane) of the vehicle lamp of the eleventh exemplary embodiment shown in FIG. 27B, within the cross section (horizontal plane) of the vehicle lamp of the twelfth exemplary embodiment shown in FIG. 29B, the light incident surface 3C2 of the lens cut portion 3C is aligned with the imaginary plane 3C1' which is defined by offsetting the light transmitting surface 3C1 of the lens cut portion 3C toward the light incident side (upward in FIG. 29C, toward the reflectors 2*a* and 2*c*). Therefore, as in the vehicle lamp of the eleventh exemplary embodiment, in the vehicle lamp of the twelfth exemplary embodiment as shown in FIG. 29B, the generally parallel light beams L2 coming from the parabolic reflective surfaces of the reflectors 2*a* and 2*c* (see FIGS. 18B and 18C) will not be diffused by the lens cut portion 3C in the left and right directions but projected as light LC traveling across a vertical plane frontward of the vehicle lamp (downward in FIG. 29B).

Furthermore, like the vehicle lamp of the eleventh exemplary embodiment, the vehicle lamp of the twelfth exemplary embodiment can be configured such that the lens cut portion 3C shown in FIGS. 29A to 29C and the lens cut portion 3D are arranged in a mirror image relationship with respect to the vertical plane containing the principal optical axis L of the vehicle lamp. Furthermore, as shown in FIG. 18B, the light sources 1*a* and 1*c* and the parabolic reflective surfaces of the reflectors 2*a* and 2*c* are arranged in a mirror image relationship with the light sources 1*b* and 1*d* and the parabolic reflective surfaces of the reflectors 2*b* and 2*d* with respect to the vertical plane containing the principal optical axis L of the vehicle lamp.

A description will now be made with respect to a vehicle lamp according to a thirteenth exemplary embodiment of the presently disclosed subject matter. The vehicle lamp of the thirteenth exemplary embodiment is configured generally in the same manner as the vehicle lamp of the tenth exemplary embodiment described above except for at least the following points. Accordingly, the vehicle lamp of the thirteenth exemplary embodiment can provide substantially the same effects as those of the vehicle lamp of the tenth exemplary embodiment described above.

Figure 30A:
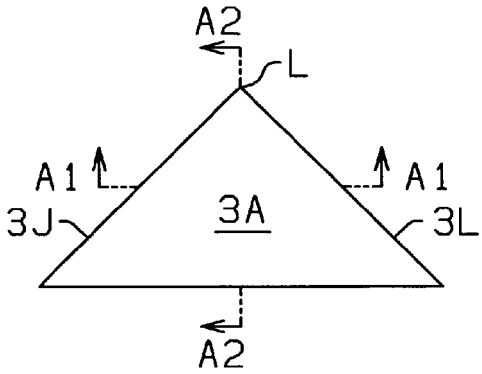
FIGS. 30A, 30B, and 30C are views illustrating in detail a lens cut portion 3A of a lens 3 of a vehicle lamp according to a thirteenth exemplary embodiment.
Figure 30C:
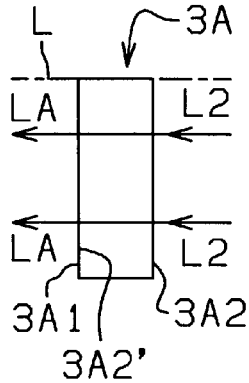
Figure 30B:
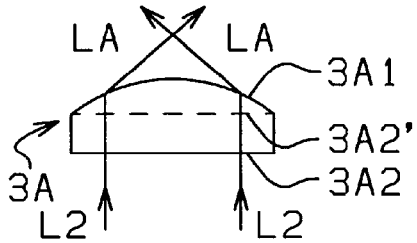

FIGS. 30A to 30C are views illustrating in detail the lens cut portion 3A of the lens 3 of the vehicle lamp of the thirteenth exemplary embodiment. More specifically, FIG. 30A is a front view of the lens cut portion 3A of the lens 3 of the vehicle lamp of the thirteenth exemplary embodiment, FIG. 30B is a cross-sectional view taken along line A1-A1 of FIG. 30A, and FIG. 30C is a cross-sectional view taken along line A2-A2 of FIG. 30A.

As in the vehicle lamp of the tenth exemplary embodiment shown in FIG. 24B, within the cross section (horizontal plane) of the vehicle lamp of the thirteenth exemplary embodiment shown in FIG. 30B, the light transmitting surface 3A1 of the lens cut portion 3A protrudes frontward of the imaginary plane 3A2' which is defined by offsetting the light incident surface 3A2 of the lens cut portion 3A toward the light transmitting side (upward in FIG. 30B, opposite to the reflectors 2*a* and 2*b*). Therefore, as in the vehicle lamp of the tenth exemplary embodiment shown in FIG. 24B, in the vehicle lamp of the thirteenth exemplary embodiment as shown in FIG. 30B, the generally parallel light beams L2 coming from the parabolic reflective surfaces of the reflectors 2*a* and 2*b* (see FIGS. 18B and 23B) are diffused by the lens cut portion 3A in the left and right directions and projected as the diffused light LA frontward of the vehicle lamp (upward in FIG. 30B).

On the other hand, within the cross section (vertical plane) of the vehicle lamp of the tenth exemplary embodiment shown in FIG. 24C, the light transmitting surface 3A1 of the lens cut portion 3A protrudes frontward of the imaginary plane 3A2' which is defined by offsetting the light incident surface 3A2 of the lens cut portion 3A toward the light transmitting side (leftward in FIG. 24C, opposite to the reflectors 2*a* and 2*b*). In contrast to this, within the cross section (vertical plane) of the vehicle lamp of the thirteenth exemplary embodiment shown in FIG. 30C, the light transmitting surface 3A1 of the lens cut portion 3A is aligned with the imaginary plane 3A2' which is defined by offsetting the light incident surface 3A2 of the lens cut portion 3A toward the light transmitting side (leftward in FIG. 30C, opposite to the reflectors 2*a* and 2*b*). Therefore, in the vehicle lamp of the thirteenth exemplary embodiment as shown in FIG. 30C, the generally parallel light beams L2 coming from the parabolic reflective surface of the reflectors 2*a* and 2*b* (see FIGS. 18B and 23B) will not be diffused by the lens cut portion 3A in the up and down directions but projected as light LA traveling across a horizontal plane frontward of the vehicle lamp (leftward in FIG. 30C).

Furthermore, like the vehicle lamp of the tenth exemplary embodiment, the vehicle lamp of the thirteenth exemplary embodiment can be configured such that the lens cut portion 3A and the lens cut portion 3B are arranged in a mirror image relationship with respect to the horizontal plane containing the principal optical axis L of the vehicle lamp. Furthermore, as shown in FIG. 18B, the light sources 1*a* and 1*b* and the parabolic reflective surfaces of the reflectors 2*a* and 2*b* are arranged in a mirror image relationship with the light sources 1*c* and 1*d* and the parabolic reflective surfaces of the reflectors 2*c* and 2*d* with respect to the horizontal plane containing the principal optical axis L of the vehicle lamp. Therefore, as in the vehicle lamp of the tenth exemplary embodiment, in the vehicle lamp of the thirteenth exemplary embodiment, the generally parallel light beams coming from the parabolic reflective surfaces of the reflectors 2*c* and 2*d* are diffused by the lens cut portion 3B in the left and right directions and projected as the diffused light frontward of the vehicle lamp (leftward in FIG. 18B). On the other hand, unlike the vehicle lamp of the tenth exemplary embodiment, the vehicle lamp of the thirteenth exemplary embodiment is configured such that the generally parallel light beams coming from the parabolic reflective surfaces of the reflectors 2*c* and 2*d* will not be diffused by the lens cut portion 3B in the up and down directions but projected frontward of the vehicle lamp (leftward in FIG. 18B) as light traveling across a horizontal plane.

Figure 31B:
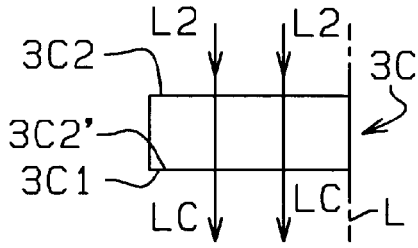
FIGS. 31A, 31B, and 31C are views illustrating in detail a lens cut portion 3C of the lens 3 of the vehicle lamp according to the thirteenth exemplary embodiment.
Figure 31C:
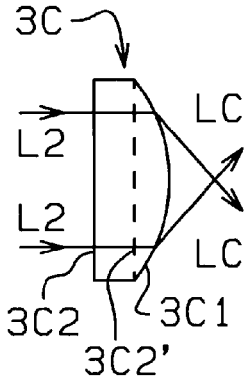
Figure 31A:
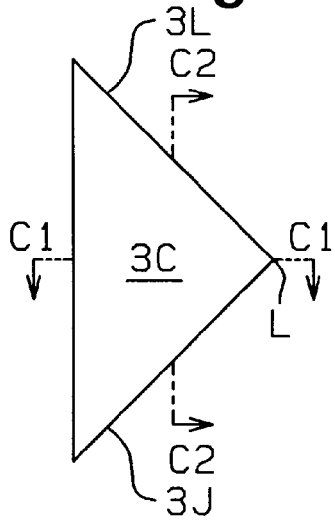

FIGS. 31A to 31C are views illustrating in detail the lens cut portion 3C of the lens 3 of the vehicle lamp of the thirteenth exemplary embodiment. More specifically, FIG. 31A is a front view of the lens cut portion 3C of the lens 3 of the vehicle lamp of the thirteenth exemplary embodiment, FIG. 31B is a cross-sectional view taken along line C1-C1 of FIG. 31A, and FIG. 31C is a cross-sectional view taken along line C2-C2 of FIG. 31A.

More specifically, as in the vehicle lamp of the eighth exemplary embodiment shown in FIG. 25C, within the cross section (vertical plane) of the vehicle lamp of the thirteenth exemplary embodiment shown in FIG. 31C, the light transmitting surface 3C1 of the lens cut portion 3C protrudes frontward of the imaginary plane 3C2' which is defined by offsetting the light incident surface 3C2 of the lens cut portion 3C toward the light transmitting side (rightward in FIG. 31C, opposite to the reflectors 2*a* and 2*c*). Therefore, as in the vehicle lamp of the tenth exemplary embodiment shown in FIG. 25C, in the vehicle lamp of the thirteenth exemplary embodiment as shown in FIG. 31C, the generally parallel light beams L2 coming from the parabolic reflective surfaces of the reflectors 2*a* and 2*c* (see FIGS. 18B and 23B) are diffused by the lens cut portion 3C in the up and down directions and projected as the diffused light LC frontward of the vehicle lamp (rightward in FIG. 31C).

On the other hand, within the cross section (horizontal plane) of the vehicle lamp of the tenth exemplary embodiment as shown in FIG. 25B, the light transmitting surface 3C1 of the lens cut portion 3C protrudes frontward of the imaginary plane 3C2' which is defined by offsetting the light incident surface 3C2 of the lens cut portion 3C toward the light transmitting side (downward in FIG. 23B, opposite to the reflectors 2*a* and 2*c*). In contrast to this, within the cross section (horizontal plane) of the vehicle lamp of the thirteenth exemplary embodiment shown in FIG. 31B, the light transmitting surface 3C1 of the lens cut portion 3C is aligned with the imaginary plane 3C2' which is defined by offsetting the light incident surface 3C2 of the lens cut portion 3C toward the light transmitting side (downward in FIG. 31B, opposite to the reflectors 2*a* and 2*c*). Therefore, in the vehicle lamp of the thirteenth exemplary embodiment as shown in FIG. 31B, the generally parallel light beams L2 coming from the parabolic reflective surfaces of the reflectors 2*a* and 2*c* (see FIGS. 18B and 23B) will not be diffused by the lens cut portion 3C in the left and right directions but projected as light LC traveling across a vertical plane frontward of the vehicle lamp (downward in FIG. 31B).

Furthermore, like the vehicle lamp of the tenth exemplary embodiment, the vehicle lamp of the thirteenth exemplary embodiment can be configured such that the lens cut portion 3C and the lens cut portion 3D are arranged in a mirror image relationship with respect to the vertical plane containing the principal optical axis L of the vehicle lamp. Furthermore, as shown in FIG. 18B and FIG. 23B, the light sources 1*a* and 1*c* and the parabolic reflective surfaces of the reflectors 2*a* and 2*c* are arranged in a mirror image relationship with the light sources 1*b* and 1*d* and the parabolic reflective surfaces of the reflectors 2*b* and 2*d* with respect to the vertical plane containing the principal optical axis L of the vehicle lamp. Therefore, like the vehicle lamp of the tenth exemplary embodiment, the vehicle lamp of the thirteenth exemplary embodiment is configured such that the generally parallel light beams coming from the parabolic reflective surfaces of the reflectors 2*b* and 2*d* are diffused by the lens cut portion 3D in the up and down directions and projected as the diffused light frontward of the vehicle lamp (leftward in FIG. 18B). On the other hand, unlike the vehicle lamp of the tenth exemplary embodiment, the vehicle lamp of the thirteenth exemplary embodiment is configured such that the generally parallel light beams coming from the parabolic reflective surfaces of the reflectors 2*b* and 2*d* will not be diffused by the lens cut portion 3D in the left and right directions but projected frontward of the vehicle lamp (leftward in FIG. 18B) as light traveling across a vertical plane.

A description will now be made with respect to a vehicle lamp according to a fourteenth exemplary embodiment of the presently disclosed subject matter. The vehicle lamp of the fourteenth exemplary embodiment is configured generally in the same manner as the vehicle lamp of the thirteenth exemplary embodiment described above except for at least the following points. Accordingly, the vehicle lamp of the fourteenth exemplary embodiment can provide substantially the same effects as those of the vehicle lamp of the thirteenth exemplary embodiment described above.

Figure 32:
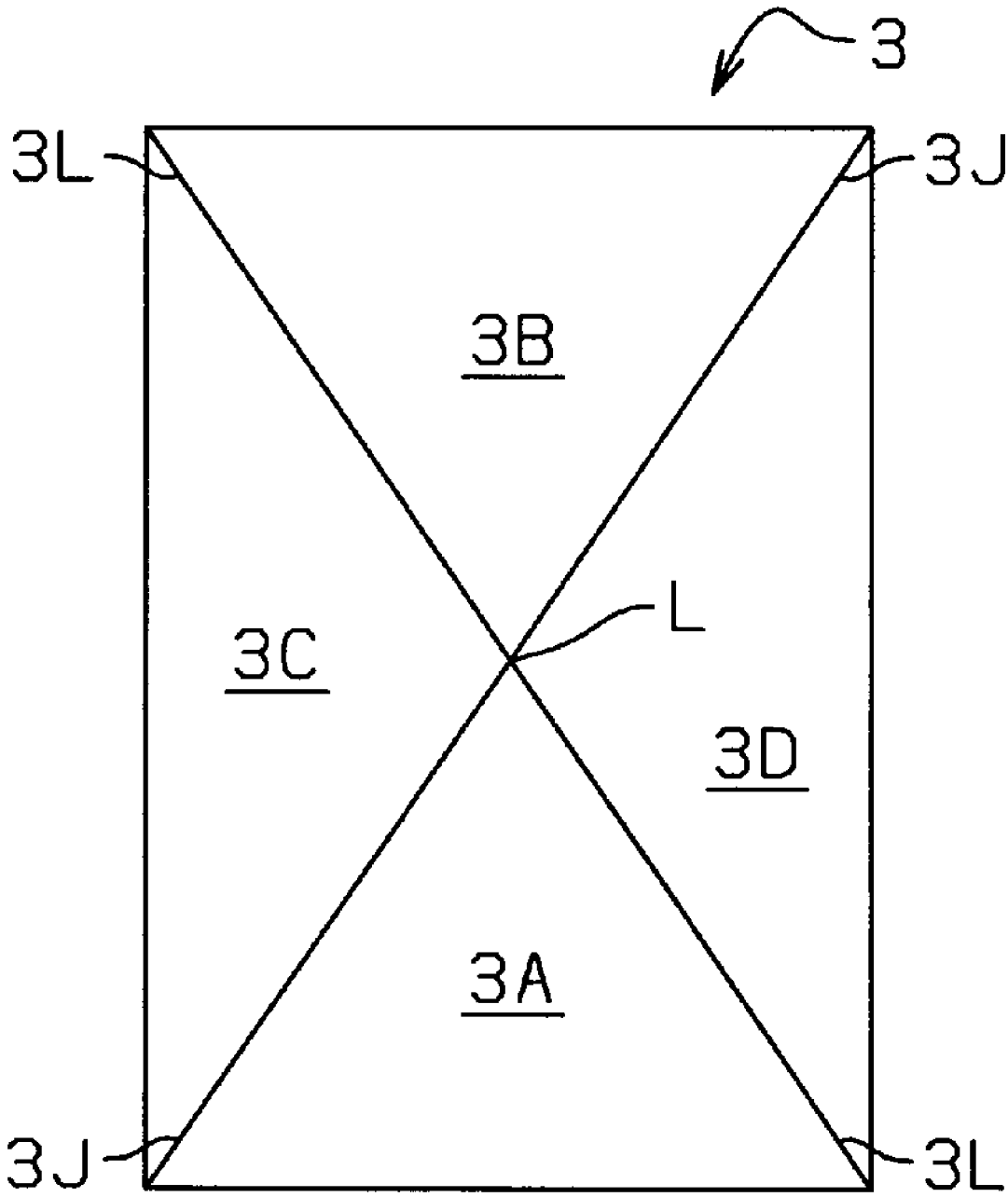
FIG. 32 is a front view illustrating a vehicle lamp of a fourteenth exemplary embodiment.

FIG. 32 is a front view of the vehicle lamp of the fourteenth exemplary embodiment. As shown in FIGS. 18A and 23A, the vehicle lamps of the eighth to thirteenth exemplary embodiments have the lens 3 that looks substantially square (or generally rectangular) when viewed from in front of the vehicle lamp. In contrast to this, as shown in FIG. 32, the vehicle lamp of the fourteenth exemplary embodiment is configured such that the lens 3 is substantially rectangular, substantially longer either in the vertical or horizontal direction, when viewed from in front of the vehicle lamp. The other features can be the same as or similar to those of the aforementioned exemplary embodiments, and thus will not be repeatedly explained here.

It should be noted that the presently disclosed subject matter allows the aforementioned first to fourteenth exemplary embodiments to be appropriately combined with each other. In addition, the vehicle lamp can be configured for use for various purposes or application, including for use as a vehicle signal lamp, rear lamp, position lamp, turn signal, fog lamp, headlamp for certain vehicles, daytime running lamp, traffic lamp, spot light, etc.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A vehicle lamp configured to emit light in a light emitting direction along a principal optical axis, the vehicle lamp comprising:

a light source;

a reflector having a parabolic reflective surface configured to reflect light beams, emitted from the light source, into generally parallel reflected light beams; and a lens formed in a generally rectangular shape and having a center and a plurality of lens cut portions configured to diffuse the generally parallel light beams coming from the parabolic reflective surface of the reflector, wherein the principal optical axis of the vehicle lamp is configured to intersect with the center of the lens, the lens includes a plurality of ridge lines or valley lines extending generally radially from the principal optical axis of the vehicle lamp and dividing the generally rectangular lens into at least a first lens cut portion, a second lens cut portion, a third lens cut portion, and a fourth lens cut portion serving as the lens cut portions, the first lens cut portion is located below a horizontal plane containing the principal optical axis of the vehicle lamp, the first lens cut portion being a substantial mirror image of the second lens cut portion located above the horizontal plane, the third lens cut portion is located to the left of a vertical plane containing the principal optical axis of the vehicle lamp, the third lens cut portion being a substantial mirror image of the fourth lens cut portion located to the right of the vertical plane, and the vehicle lamp is configured such that the generally parallel light beams coming from the parabolic reflective surface of the reflector are diffused at least in the left and right directions through the first lens cut portion and the second lens cut portion, and at the same time, the generally parallel light beams coming from the parabolic reflective surface of the reflector are diffused at least in the up and down directions through the third lens cut portion and the fourth lens cut portion.

2. The vehicle lamp according to claim 1, wherein the lens cut portions have a light transmitting surface located a distance from the light source and a light incident surface located a second distance from the light source and closer to the light source, with the light incident surface protruding rearward of an imaginary plane which is defined by offsetting the light transmitting surface of the lens cut portions toward the light incident side, thereby allowing the lens cut portions to diffuse the generally parallel light beams coming from the parabolic reflective surface of the reflector, at least in one of the left and right directions and the up and down directions.

3. The vehicle lamp according to claim 1, wherein the lens cut portions have a light transmitting surface located a distance from the light source and a light incident surface located a second distance from the light source and closer to the light source, with the light transmitting surface protruding frontward of an imaginary plane which is defined by offsetting the light incident surface of the lens cut portions toward the light transmitting side, thereby allowing the lens cut portions to diffuse the generally parallel light beams coming from the parabolic reflective surface of the reflector at least in one of the left and right directions and the up and down directions.

4. The vehicle lamp according to claim 1, wherein one of the lens cut portions is located on one side, separated by one of the ridge line or valley lines, from an other of the lens cut portions located on an other side of the one of the ridge line or valley lines, and the one of the lens cut portions is coupled to the other of the lens cut portions at the one of the ridge line or valley lines.

5. The vehicle lamp according to claim 2, wherein one of the lens cut portions is located on one side, separated by one of the ridge line or valley lines, from an other of the lens cut portions located on an other side of the one of the ridge line or valley lines, and the one of the lens cut portions is coupled to the other of the lens cut portions at the one of the ridge line or valley lines.

6. The vehicle lamp according to claim 3, wherein one of the lens cut portions is located on one side, separated by one of the ridge line or valley lines, from an other of the lens cut portions located on an other side of the one of the ridge line or valley lines, and the one of the lens cut portions is coupled to the other of the lens cut portions at the one of the ridge line or valley lines.

7. The vehicle lamp according to claim 1, wherein the lamp is a vehicle signal lamp.

8. The vehicle lamp according to claim 3, wherein the light incident surface protrudes convexly frontward of the imaginary plane.

9. The vehicle lamp according to claim 2, wherein the light incident surface protrudes convexly rearward of the imaginary plane.

10. The vehicle lamp according to claim 1, wherein the light source is configured to emit light along a light source optical axis that is completely spaced from and does not intersect the principal optical axis of the vehicle lamp.

11. The vehicle lamp according to claim 1, wherein the light source is configured to emit light along a light source optical axis and in a direction that extends away from the light emitting direction of the vehicle lamp at an angle substantially equal to or greater than 90 degrees with respect to the principal optical axis of the vehicle lamp.

12. The vehicle lamp according to claim 1, further comprising a second light source, a third light source, and a fourth light source, wherein the light source, the second light source, the third light source, and the fourth light source each comprise a light emitting diode.

13. A vehicle lamp configured to emit light in a light emitting direction along a principal optical axis, the vehicle lamp comprising:

a light source configured to emit light along a light source optical axis that is completely spaced from and does not intersect the principal optical axis of the vehicle lamp;

a reflector having a reflective surface configured to reflect light emitted from the light source; and a lens having a center and a plurality of lens cut portions configured to diffuse the light coming from the reflective surface of the reflector, the lens includes a plurality of convex portions that extend into valleys located between the convex portions and which valleys divide the lens into at least a first lens cut portion, a second lens cut portion, a third lens cut portion, and a fourth lens cut portion serving as the lens cut portions, wherein the first lens cut portion is located below a horizontal plane containing the principal optical axis of the vehicle lamp and the second lens cut portion is located above the horizontal plane, the third lens cut portion is located to the left of a vertical plane containing the principal optical axis of the vehicle lamp and the fourth lens cut portion is located to the right of the vertical plane, and the vehicle lamp is configured such that the light coming from the reflective surface of the reflector is diffused at least in left and right directions through the first lens cut portion and the second lens cut portion, and at the same time, the light coming from the reflective surface of the reflector is diffused at least in up and down directions through the third lens cut portion and the fourth lens cut portion.

14. The vehicle lamp according to claim 13, wherein the light source is configured to emit light along a light source optical axis and in a direction that extends away from the light emitting direction of the vehicle lamp at an angle substantially equal to or greater than 90 degrees with respect to the principal optical axis of the vehicle lamp.

15. The vehicle lamp according to claim 13, wherein the lens cut portions have a light transmitting surface located a distance from the light source and a light incident surface located a second distance from the light source and closer to the light source, with the light incident surface protruding convexly rearward of an imaginary plane which is defined by offsetting the light transmitting surface of a respective one of the lens cut portions toward the light incident side, thereby allowing the respective one of the lens cut portions to diffuse the light coming from the reflective surface of the reflector, at least in one of the left and right directions and the up and down directions.

16. The vehicle lamp according to claim 13, wherein the lens cut portions have a light transmitting surface located a distance from the light source and a light incident surface located a second distance from the light source and closer to the light source, with the light transmitting surface protruding convexly frontward of an imaginary plane which is defined by offsetting the light incident surface of a respective one of the lens cut portions toward the light transmitting side, thereby allowing the respective one of the lens cut portions to diffuse the light coming from the reflective surface of the reflector, in at least one of the left and right directions and the up and down directions.

17. The vehicle lamp according to claim 13, wherein a first of the lens cut portions located on one side of one of the valley lines and a second of the lens cut portions located on an other side of the one of the valley lines are coupled to each other at the one of the valley lines.

18. The vehicle lamp according to claim 13, wherein the lamp is a vehicle signal lamp.

19. The vehicle lamp according to claim 13, further comprising:

a second light source, a third light source and a fourth light source.

20. The vehicle lamp according to claim 19, wherein the light source, the second light source, the third light source, and the fourth light source each comprise a light emitting diode.

* * * * *